US009962737B2

(12) United States Patent
Kandori et al.

(10) Patent No.: US 9,962,737 B2
(45) Date of Patent: May 8, 2018

(54) CAPACITANCE TYPE TRANSDUCER, MANUFACTURING METHOD THEREFOR, AND SUBJECT INFORMATION ACQUIRING APPARATUS

(71) Applicant: CANON KABUSHIKI KAISHA, Tokyo (JP)

(72) Inventors: Atsushi Kandori, Ebina (JP); Yoshio Hotta, Kamakura (JP)

(73) Assignee: Canon Kabushiki Kaisha, Tokyo (JP)

( * ) Notice: Subject to any disclaimer, the term of this patent is extended or adjusted under 35 U.S.C. 154(b) by 87 days.

(21) Appl. No.: 14/675,965

(22) Filed: Apr. 1, 2015

(65) Prior Publication Data

US 2015/0290679 A1 Oct. 15, 2015

(30) Foreign Application Priority Data

Apr. 12, 2014 (JP) ..... 2014-082382

(51) Int. Cl.
*B06B 1/02* (2006.01)
*G10K 11/00* (2006.01)

(52) U.S. Cl.
CPC ..... *B06B 1/0292* (2013.01); *G10K 11/004* (2013.01)

(58) Field of Classification Search
CPC ..... B06B 1/0292; G10K 11/004
See application file for complete search history.

(56) References Cited

U.S. PATENT DOCUMENTS 8,754,660 B2 6/2014 Kandori et al.
8,758,253 B2 6/2014 Sano et al.
8,787,117 B2 7/2014 Kandori
8,953,414 B2 2/2015 Kandori
2010/0036257 A1 2/2010 Sano et al.
2012/0103096 A1 5/2012 Kandori
2012/0218867 A1 8/2012 Kandori et al.
2013/0261425 A1 10/2013 Kawabata et al.
2014/0285219 A1 9/2014 Kandori et al.
2015/0009778 A1 1/2015 Kandori et al.
2015/0290679 A1* 10/2015 Kandori ..... B06B 1/0292 367/7

FOREIGN PATENT DOCUMENTS

EP 2289419 A1 3/2011
JP 2015207995 A * 11/2015

OTHER PUBLICATIONS

Extended European Search Report in European Application No. 15163116.5 (dated Sep. 25, 2015).
A.S. Ergun et al., "Capacitive Micromachined Ultrasonic Transducers: Fabrication Technology," 52(12) IEEE Transactions on Ultrasonics, Ferroelectrics, and Frequency Control 2242-2258 (Dec. 2005).
First Office Action in Chinese Application No. 201510166889.5 (dated Apr. 1, 2017).

* cited by examiner

*Primary Examiner* — Daniel Pihulic
(74) *Attorney, Agent, or Firm* — Fitzpatrick, Cella, Harper & Scinto

(57) ABSTRACT

A capacitance type transducer includes one or more cells having a structure in which a vibrating film including one electrode of a pair of electrodes formed spaced apart from each other is supported to be capable of vibrating. The cells are disposed on one surface of a substrate. An acoustic matching layer is provided between a water-resistant sheet and the cells. A water-resistant frame is disposed to surround a side surface of the substrate. The sheet is bonded to an end face of the frame to cover an opening of the frame.

36 Claims, 20 Drawing Sheets

CAPACITANCE TYPE TRANSDUCER, MANUFACTURING METHOD THEREFOR, AND SUBJECT INFORMATION ACQUIRING APPARATUS

BACKGROUND OF THE INVENTION

Field of the Invention

The present invention relates to a capacitance type transducer that performs transmission and reception of an acoustic wave such as an ultrasonic wave (in this specification, transmission and reception means at least one of transmission and reception), a manufacturing method for the capacitance type transducer, and a subject information acquiring apparatus such as an ultrasonic image forming apparatus including the capacitance type transducer. In this specification, the acoustic wave includes waves called sound wave, ultrasonic wave, and photoacoustic wave. However, the acoustic wave is sometimes represented by the ultrasonic wave. The photoacoustic wave is an acoustic wave generated inside a subject by irradiation of light (an electromagnetic wave) such as a visible ray or an infrared ray to the inside of the subject.

Description of the Related Art

A CMUT (Capacitive Micromachined Ultrasonic Transducer), which is a capacitance type ultrasonic transducer, has been proposed for the purpose of performing transmission and reception of an ultrasonic wave. The CMUT is manufactured using a MEMS (Micro Electro Mechanical Systems) process to which a semiconductor process is applied.

A schematic diagram of a cross section of an example of a CMUT (a transmitting and receiving element) is illustrated in FIG. 19 (see A. S. Ergun, Y. Huang, X. Zhuang, O. Oralkan, G. G. Yarahoglu, and B. T. Khuri-Yakub, "Capacitive micromachined ultrasonic transducers: fabrication technology," Ultrasonics, Ferroelectrics and Frequency Control, IEEE Transactions on, vol. 52, no. 12, pp. 2242-2258, December 2005). A structure including a first electrode 102 and a second electrode 103 opposed to a vibrating film 101 across a gap (a cavity) 105 is set as one set and referred to as cell. The vibrating film 101 is supported by a supporting section 104 formed on a chip 201. A direct-current voltage generating unit 311 is connected to the first electrode 102. A predetermined direct-current voltage Va is applied to the first electrode 102. The second electrode 103 is connected to a transmission and reception circuit 312 and set to fixed potential near the GND potential. Consequently, a potential difference of Vbias=Va−0 V is generated between the first electrode 102 and the second electrode 103. When a value of Va is adjusted, a value of Vbias coincides with a desired potential difference (approximately several tens volts to several hundred volts) determined by a mechanical characteristic of cells of the CMUT. When an alternating-current driving voltage is applied to the second electrode 103 by the transmission and reception circuit 312, alternating-current electrostatic attraction is generated between the first and second electrodes 102 and 103. An ultrasonic wave can be transmitted by vibrating the vibrating film 101 at a certain frequency. The vibrating film 101 receives the ultrasonic wave and vibrates, whereby micro current is generated by electrostatic induction in the second electrode 103. It is possible to extract a reception signal by measuring a current value of the micro current using the transmission and reception circuit 312. Note that, in the above description, a direct-current voltage generating unit 311 is connected to the first electrode 102 and the second electrode 103 is connected to the transmission and reception circuit 312. However, the transmission and reception circuit 312 may be connected to the first electrode 102 and the second electrode 103 may be connected to the direct-current voltage generating unit 311.

In general, an electrode included in a CMUT includes a metal thin film. A layer containing silicone, through which an ultrasonic wave is easily transmitted, as a main component is formed on the CMUT. The silicone has a high insulation property. Electric safety can be secured by insulation resistance. However, since the permeability of water vapor is high, the water vapor sometimes intrudes into a wire in the CMUT. Consequently, corrosion of the wire occurs because of the water vapor and ionized or micronized substances permeating together with the water vapor. A problem of reliability such as deterioration in the sensitivity of the CMUT sometimes occurs. Therefore, it is necessary to reduce the intrusion of the water vapor from the outside while minimizing the influence on a transmission and reception characteristic of the CMUT. Depending on a use of the CMUT, a packaging size needs to be kept within a small region. Therefore, there is a demand to reduce the intrusion of the water vapor, which causes the corrosion of the wire in the CMUT, and set the packaging size as close as possible to the size of a substrate to reduce the size of the CMUT.

Therefore, it is an object of the present invention to provide a capacitance type transducer that can reduce occurrence of corrosion of a wire due to intrusion of substances from the outside and has reduced influence on a transmission and reception characteristic.

SUMMARY OF THE INVENTION

In order to attain the object, a capacitance type transducer of the present invention has characteristics described below. The capacitance type transducer includes one or more cells having a structure in which a vibrating film including one electrode of a pair of electrodes formed spaced apart from each other is supported to be capable of vibrating, a substrate, on one surface of which the one or more cells are disposed, a sheet having water resistance, an acoustic matching layer provided between the sheet and the cells, and a frame having water resistance and disposed to surround a side surface of the substrate. The sheet is bonded to an end face of the frame to cover an opening of the frame.

Further features of the present invention will become apparent from the following description of exemplary embodiments with reference to the attached drawings.

DESCRIPTION OF THE EMBODIMENTS

Figure 1A:
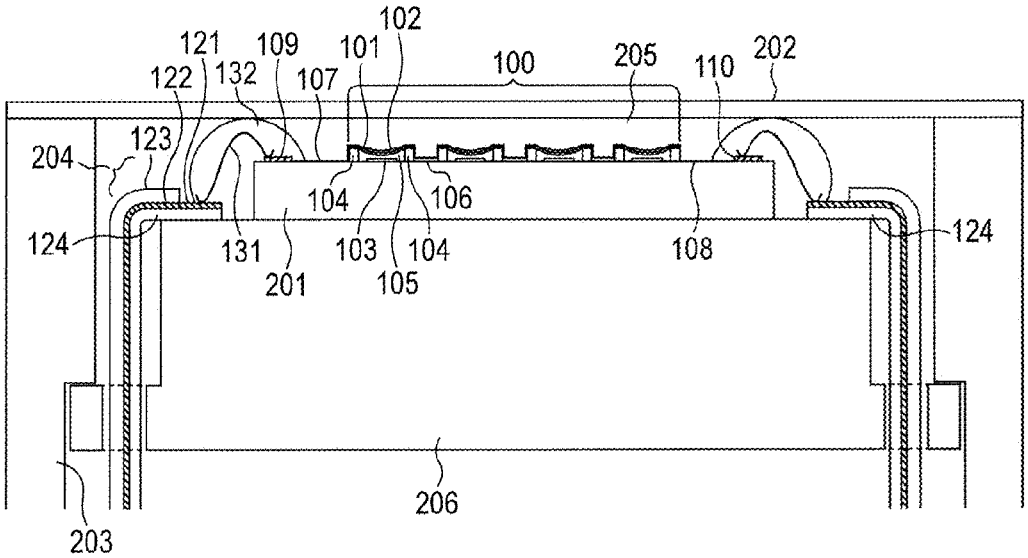
FIGS. 1A, 1B, and 1C are diagrams for describing a capacitance type transducer according to a first embodiment.

Preferred embodiments of the present invention will now be described in detail in accordance with the accompanying drawings.

In a capacitance type transducer of the present invention, to cover an opening of a water-resistant frame disposed to surround a side surface of a substrate including cells, a water-resistant sheet is bonded to an end face of the frame. Consequently, it is possible to reduce occurrence of corrosion of a wire due to substances intruding from the outside.

Embodiments of the present invention are described below. An embodiment of a capacitance type transducer of the present invention includes a sheet that prevents permeation of water vapor and a frame that prevents permeation of water vapor. The surface of the CMUT is covered by the sheet. A side surface of a substrate forming the CMUT is entirely surrounded by the frame. One end face of the frame is entirely bonded to the sheet and covered.

Embodiments of a capacitance type transducer and an ultrasonic image forming apparatus, which is a type of a subject information acquiring apparatus, of the present invention are described in detail below in accordance with the accompanying drawings. Note that, concerning members configuring the capacitance type transducer of the present invention, even if figure numbers are different, members representing the same parts are denoted by the same reference numerals and signs and are sometimes not described in each of the drawings.

First Embodiment

Figure 1B:
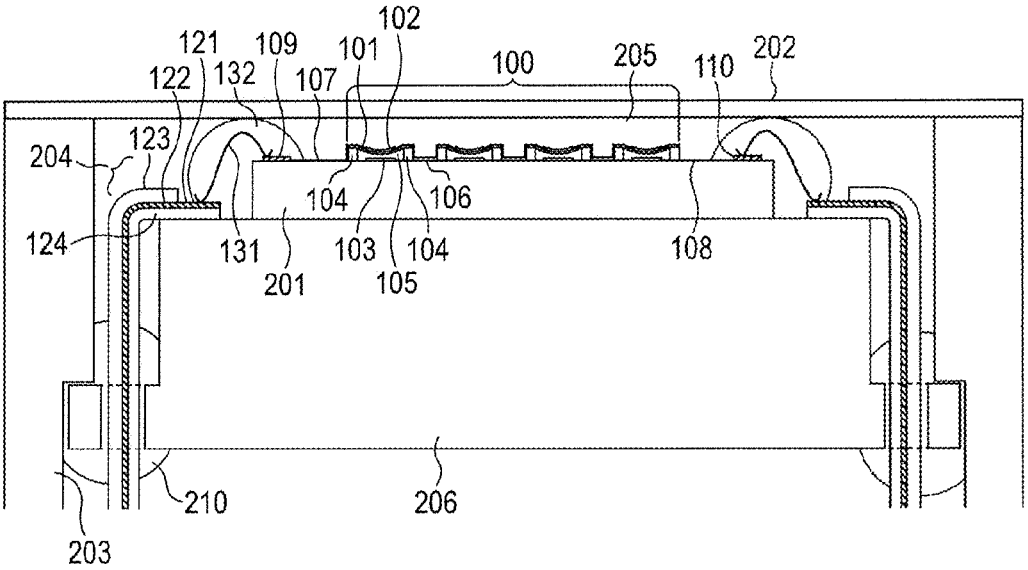
Figure 1C:
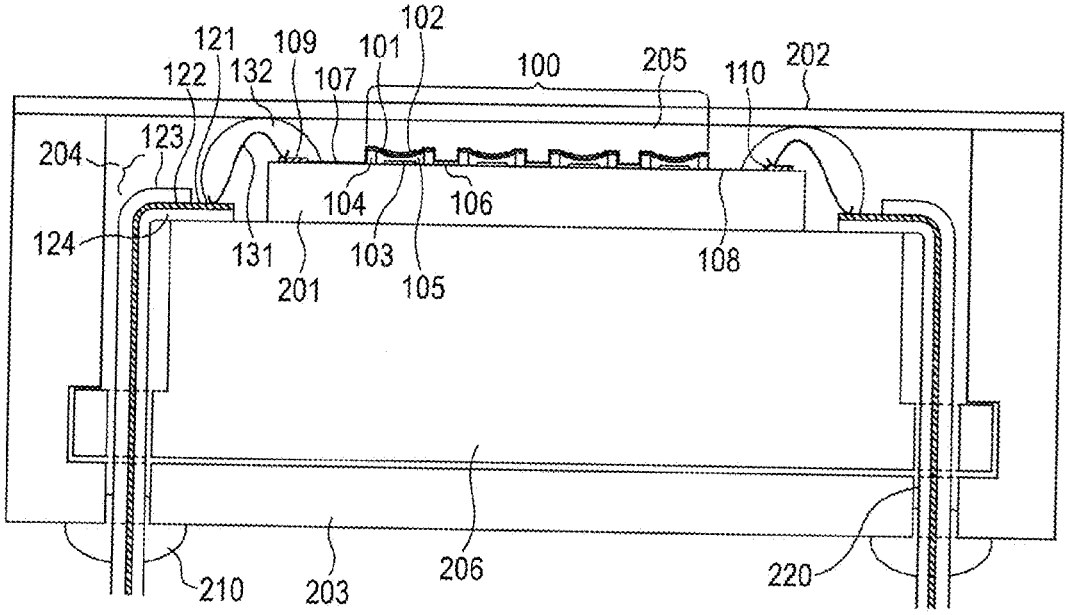

FIGS. 1A and 1B and FIGS. 2A and 2B are schematic diagrams of a capacitance type transducer according to this embodiment. The capacitance type transducer includes a substrate 201, a sheet 202, a frame 203, a flexible wiring board 204, a silicone layer 205, which is an acoustic matching layer, and a supporting member 206. FIGS. 1A to 1C are schematic diagrams illustrating an X-Y cross section in FIGS. 2A to 2C.

A CMUT 100 is formed on the substrate 201. The CMUT 100 includes a vibrating film 101, a first electrode 102, a second electrode 103, a supporting section 104, wires 107 and 108, and electrodes 109 and 110. Each of one or more cells has a structure in which the vibrating film 101 including one electrode 102 of a pair of electrodes 102 and 103 formed with a space 105 apart from each other is supported to be capable of vibrating. On the substrate 201, the second electrode 103 and the supporting section 104 are disposed. The first electrode 102 is disposed on the vibrating film 101 supported by the supporting section 104. The first electrode 102 and the second electrode 103 are disposed to be opposed to each other. The vibrating film 101 vibrates integrally with the first electrode 102. The wires 107 and 108 and the electrodes 109 and 110 are formed by forming a metal thin film of aluminum, copper, gold, nickel, or titanium. The wires 107 and 108 and the electrodes 109 and 110 have thickness of several hundred nanometers to several micrometers and line width and conductor spacing of several micrometers to several hundred micrometers.

Figure 3A:
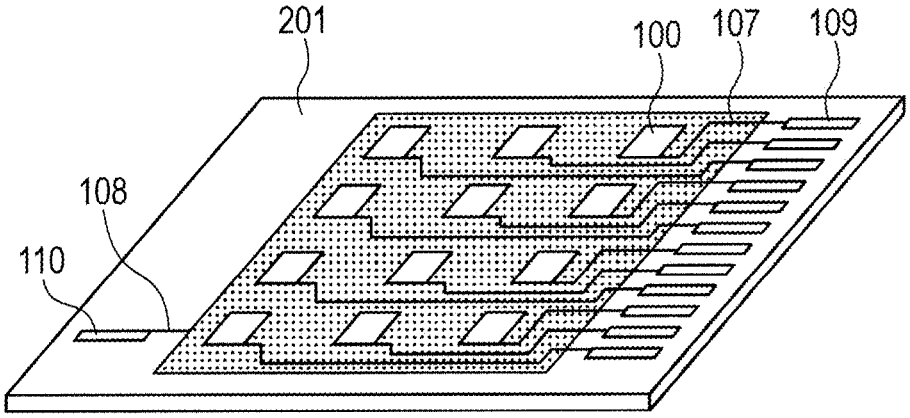
FIGS. 3A and 3B are diagrams for describing a capacitance type transducer according to a third embodiment.
Figure 3B:
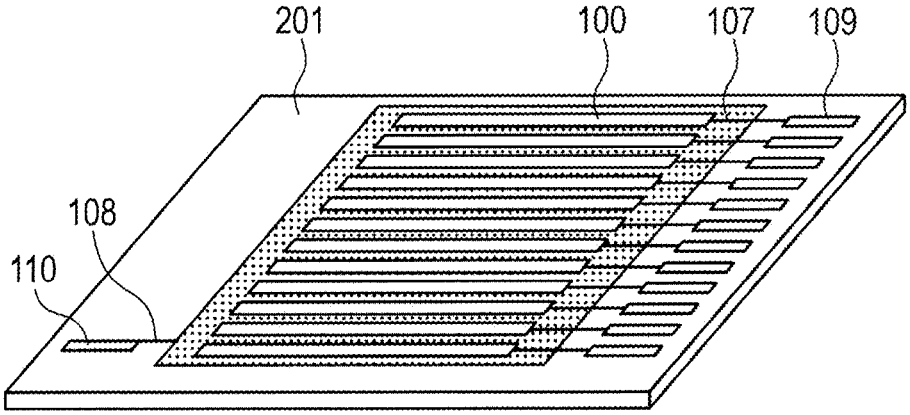

The first electrode 102 and the second electrode 103 are respectively connected to a direct-current voltage generating unit (not illustrated in the figure) and a transmission and reception circuit (not illustrated in the figure) via the flexible wiring board 204. The first electrode 102 is connected to the electrode 109 via the wire 107. The second electrode 103 is connected to the electrode 110 via the wire 108 (see FIGS. 3A to 3B as well). The flexible wiring board 204 has a configuration in which a thin conductive layer 122 is sandwiched by a thin insulating layer 123 and an insulating layer 124. The thickness of the conductive layer and the insulating layers is approximately several micrometers to several tens micrometers. The flexible wiring board 204 is easily bent. The conductive layer 122 can be formed of copper. The insulating layers 123 and 124 can be formed of polyimide. Both ends of the flexible wiring board 204 are formed as electrodes 121 in which an insulating layer is not partially formed and the conductive layer 122 is exposed. In the portions of the electrodes 121, both the ends are connected to an electrode on the substrate 201 by electric connection means described below. The other side of the flexible wiring board 204 is connected to the direct-current voltage generating unit (not illustrated in the figure) and the transmission and reception circuit (not illustrated in the figure) on the circuit board.

In FIGS. 1A to 1C, the substrate 201 is disposed side by side with the flexible wiring board 204 on the supporting member 206. The electrodes 109 and 110 and the electrode 121 are electrically connected by a wire 131. The wire 131 is covered with a sealing material 132. The wire 131 is fixed to the substrate 201 and the flexible wiring board 204 and protected from deformation due to a shock from the outside. The sealing material 132 can be easily realized using a resin adhesive such as epoxy.

The supporting member 206 can be formed of resin. A projection of the supporting member 206 is fit in a recess of a part of a frame 203. The frame 203 and the supporting member 206 can be set in a desired positional relation by assembling the frame 203 and the supporting member 206. Consequently, it is possible to have a desired relative relation of the position of the CMUT 100 formed on the substrate 201 on the supporting member 206 with respect to the frame 203. Note that a configuration opposite to the above description, that is, one of a fitting structure and an abutting structure in which the frame 203 includes a projection and the supporting member 206 includes a recess can also be used.

On the surface of the CMUT 100 on the substrate 201, the silicone layer 205 is formed as an acoustic matching layer. The acoustic matching layer desirably has acoustic impedance close to the acoustic impedance of the vibrating film 101. Specifically, the acoustic impedance is desirably 1 MRayls or more and 2 MRayls or less. In this embodiment, the silicone layer 205 is used as the acoustic matching layer. The silicone layer 205 is silicone rubber crosslinked with organic polymer containing polydimethylsiloxane (PDMS) as a main component. The silicone layer 205 may be the PDMS added with silica particles or may be fluorosilicone obtained by replacing a part of hydrogen of the PDMS with fluorine. The acoustic matching layer desirably affects the vibrating film 101 little. The thickness of the acoustic matching layer is desirably 10 μm or more and 900 μm or less. The Young's modulus of the acoustic matching layer is desirably 10 MPa or less not to greatly change mechanical characteristics such as a deformation amount and a spring constant of the vibrating film 101. In the case of the silicone rubber crosslinked with organic polymer containing polydimethylsiloxane (PDMS) as a main component, a Young's modulus is approximately 1 MPa. The water-resistant sheet 202 is disposed on the silicone layer 205. An end face (a side surface) of the substrate 201 is completely surrounded in all directions by the water-resistant frame 203. The sheet 202 is entirely bonded to the end face of the frame 203 without a gap. An opening of the frame 203 is covered by the sheet 202 (see FIG. 2A). A permeation amount of water vapor related to water resistance is represented by an amount of water vapor permeating per unit area at 40° C. and 90% RH (relative humidity). As a result of examining water permeability for suppressing corrosion and deterioration of a wire, the water permeability is desirably 100 g/m$^2$ per day. The water permeability depends on the thickness of a member. A frame member is required to have mechanical strength as well. Therefore, the water permeability can be reduced to provide a certain degree of thickness of the member.

On the other hand, the water permeability of the sheet 202 tends to be large because the sheet 202 is thin. In this embodiment, the frame member is disposed in the vicinity of the substrate side surface and bonded to the end face of the frame 203 to reduce the area of the sheet 202. The sheet 202 desirably does not deteriorate characteristic of an ultrasonic sound when the ultrasonic sound is transmitted through the sheet 202. When a transmission characteristic of the ultrasonic wave is taken into account, the thickness of the sheet 202 is desirably set to approximately 1/16 to 1/10 of the wavelength of a frequency of an ultrasonic wave used for transmission and reception. For example, during use at a frequency of approximately 10 MHz of general transmission and reception, the thickness of the sheet 202 is desirably set to thickness less than 30 micrometer. From these conflicting requests, the thickness of the sheet 202 is desirably 30 μm or less and the water permeability of the sheet 202 is 60 g/m$^2$ per day or less. Therefore, the sheet 202 desirably has a characteristic that the water vapor permeability is small. Sheets of polyethylene terephthalate, polyethylene naphthalate, polypropylene and the like are desirable as the sheet 202.

The sheet 202 is not limited to a single resin sheet. A sheet including a barrier layer for reducing permeation of water vapor can also be used. As the barrier layer included in the sheet, any layer can be used as long as the water vapor permeability can be reduced by forming a thin film of an inorganic material such as an oxide film or a thin metal layer and the layer has necessary adhesion. Consequently, besides the sheets described above, a variety of sheets of polyethylene, PVC (polyvinyl chloride), PC (polycarbonate), and PI (polyimide) can be used.

Figure 2A:
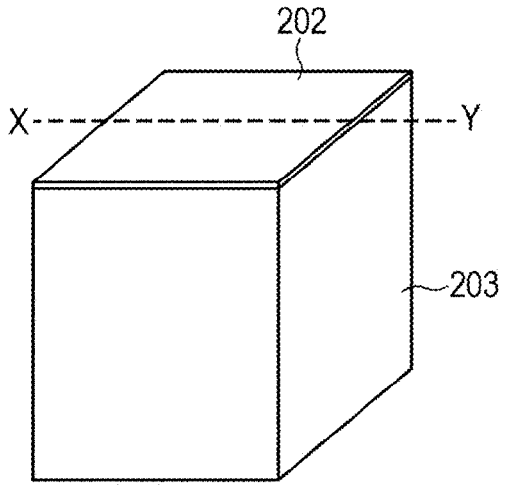
FIGS. 2A, 2B, and 2C are diagrams for describing a capacitance type transducer according to a second embodiment.
Figure 2B:
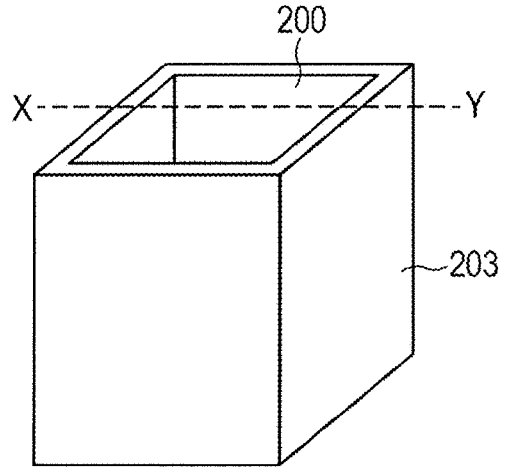

In FIG. 2B, a schematic diagram of the frame 203 used in this embodiment is illustrated. The frame 203 has a square pole shape having a square cross section and including a hollow (an opening) 200. The frame 203 has a characteristic that water vapor permeability is equal to or higher than the water vapor permeability of the sheet 202. The frame 203 can be easily formed using plastic resin such as polystyrene, polyethylene, polypropylene, PBT (polybutylene terephthalate), or PEEK (polyether ether ketone).

In this embodiment, the side surface of the substrate 201 is surrounded in all directions by the frame 203. The frame 203 is covered by the sheet 202. Therefore, according to this embodiment, it is possible to reduce intrusion of water vapor not only from the CMUT surface side but also from the periphery and the side surface of the substrate 201. In this embodiment, the sheet 202 is bonded entirely to the end face of the frame 203 without a gap. Therefore, even in a region where the sheet 202 is not disposed, it is also possible to reduce, with the frame 203, intrusion of water vapor to the CMUT 100. Therefore, compared with the configuration only including the sheet 202 on the surface of the substrate 201, it is possible to suppress intrusion of water vapor from the end portion of the sheet 202 and a region wider than the size of the sheet 202.

A configuration other than this embodiment is examined. In order to wrap the CMUT 100 with the sheet 202, the sheet 202 always needs to be overlaid in some region. When the sheet 202 is overlaid, a configuration is complicated. It is difficult to fit the sheet 202 in a small region. In addition, it is extremely difficult to prevent a gap from occurring in a region where the sheet 202 is overlaid. Therefore, reliability cannot be considerably improved. Further, a manufacturing process is complicated and manufacturing costs increase. On the other hand, in a configuration in which the sheet 202 is bonded to a side surface of a housing without being overlaid, a region where the sheet 202 is bonded to the side surface of the housing without being greatly bent is necessary. Therefore, it is necessary to form the housing considerably large with respect to the substrate 201. It is difficult to reduce the size of the housing. In this embodiment, using the frame 203, the sheet 202 is bonded to the end face of the frame 203 and the opening of the frame 203 is covered by the sheet 202. Therefore, the substrate 201, on which the CMUT 100 is formed, can be surrounded by, in a small size, a member having low water vapor permeability.

As described above, according to this embodiment, it is possible to reduce intrusion of water vapor from the outside in a small packaging size. Therefore, it is possible to reduce, in a small size, occurrence of wire corrosion due to substances intruding from the outside. Consequently, it is possible to provide the capacitance type transducer having high reliability.

Second Embodiment

A second embodiment is different from the first embodiment in a material forming the frame 203. Otherwise, the second embodiment is the same as the first embodiment. The frame 203 in this embodiment is formed of metal. Consequently, compared with when the frame 203 is formed of resin, it is possible to substantially reduce water vapor permeability. Therefore, intrusion of water vapor from the sheet 202 on the surface side of the substrate 201 only has to be considered. It is possible to reduce permeation of water vapor in total. Since the mechanical strength of the frame 203 can be increased compared with resin, it is possible to further reduce the size of the frame 203. The acoustic impedance of the metal is close to the acoustic impedance of the substrate 201. Therefore, compared with when the resin is used, irregular reflection of an ultrasonic wave around the substrate 201 is less. A transmission and reception characteristic of the CMUT 100 is less affected.

According to this embodiment, it is possible to provide a capacitance type transducer having higher reliability, smaller in size, and having a more excellent transmission and reception characteristic.

Third Embodiment

A third embodiment is different from the first and second embodiments in a configuration on a side of the frame 203 to which the sheet 202 is not bonded (for convenience of description, hereinafter referred to as bottom surface side). Otherwise, the third embodiment is the same as one of the first and second embodiments.

In this embodiment, as illustrated in FIG. 1B, on the bottom surface side of the frame 203, a gap between the frame 203 and the supporting member 206 and the flexible wiring board 204 is filled with a sealing material 210. As the sealing material 210, epoxy resin is used. The epoxy resin is a material having low water vapor permeability and suitable for the sealing material 210. According to this embodiment, the substrate 201, on which the CMUT 100 is formed, can be entirely covered with a member having low water vapor permeability. Therefore, it is possible to prevent intrusion of water vapor into the CMUT 100 from all directions. Therefore, it is possible to provide a capacitance type transducer without higher reliability without changing a size.

Figure 2C:
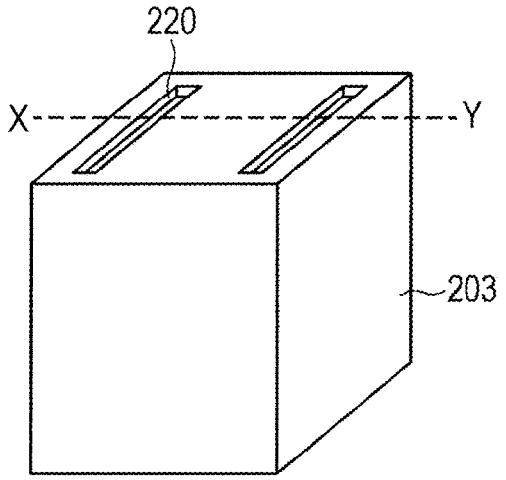

Another configuration in this embodiment is described with reference to FIGS. 1C and 2C. In this form, the frame 203 has a square cross section and is hollow inside. The frame 203 has a square pole shape including a bottom surface having long holes in a part thereof. FIG. 2C is a schematic diagram of the frame 203 viewed from the bottom surface side. The flexible wiring board 204 can be drawn out to the outer side of the frame 203 through holes 220 of the bottom surface of the frame 203. On the bottom surface side of the frame 203, a gap between the holes 220 of the frame 203 and the supporting member 206 and the flexible wiring board 204 is filled by the sealing material 210. With this configuration, since an area sealed by the sealing material 210 can be minimized, it is possible to more surely seal the frame 203. Therefore, according to this form, it is possible to provide a capacitance type transducer having higher reliability and smaller in size.

Fourth Embodiment

A fourth embodiment is different from the first to third embodiments in a wire connecting method between the substrate 201 and the flexible wiring board 204 and a positional relation between the flexible wiring board 204 and the sheet 202. Otherwise, the fourth embodiment is the same as any one of the first to third embodiments. The fourth embodiment is described with reference to FIG. 4.

In this embodiment, the electrodes 109 and 110 on the substrate 201 and the electrode 121 on the flexible wiring board 204 are connected using ACF (anisotropically conductive) resin (not illustrated in the figure). The ACF resin is insulative thermosetting resin containing fine conductive metal particles. By disposing the ACF resin between electrodes and applying pressure to the ACF resin, the conductive metal particles are interposed between the electrodes. The electrodes can be electrically connected. On the other hand, between electrodes adjacent to each other, the conductive metal particles are only dispersed and present in the insulative resin. Therefore, insulation is electrically kept. In this state, by applying heat to the resin and hardening the resin, a connected state of the upper and lower electrodes and an insulated state of the adjacent electrodes are maintained.

Figure 4:
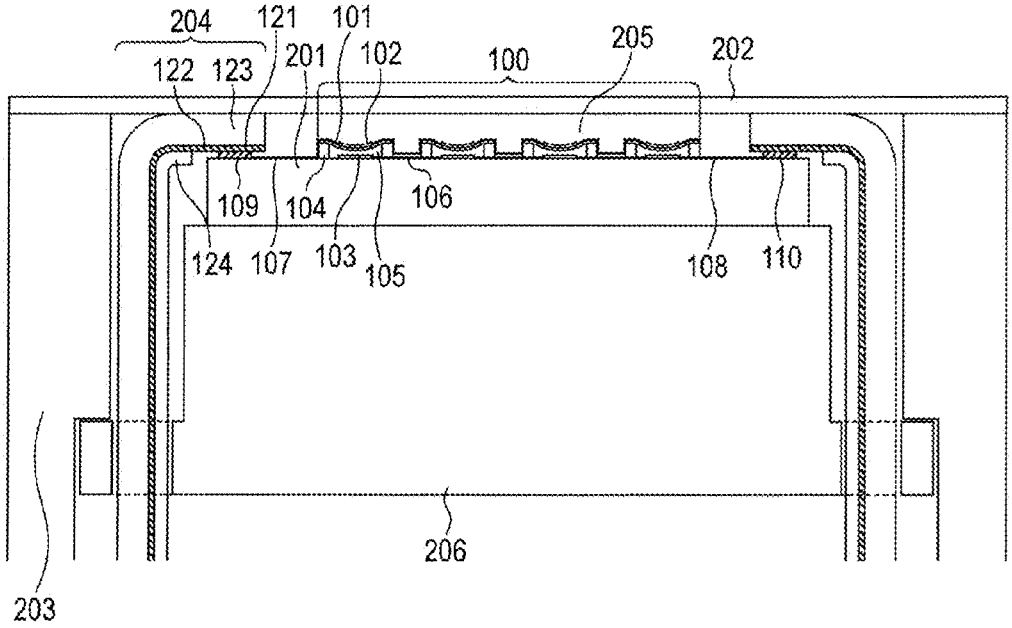
FIG. 4 is a diagram for describing a capacitance type transducer according to a fourth embodiment.

In this embodiment, since the ACF resin is used for electric connection, as illustrated in FIG. 4, the flexible wiring board 204 is directly disposed on the substrate 201. In this embodiment, the surface of the flexible wiring board 204 on the opposite side of the substrate 201 is in contact with the sheet 202.

With this configuration, the distance between the surface of the substrate 201 and the sheet 202 can be defined by the thickness of the flexible wiring board 204. As the thickness of the flexible wiring board 204, thickness of several tens micrometers to several hundred micrometers can be selected by changing the thickness of an insulating layer and a conductive layer. By using the flexible wiring board 204 having desired thickness, it is possible to set the distance between the substrate 201 and the sheet 202 to a desired distance. Therefore, it is possible to set the thickness of the silicone layer 205 on the CMUT 100 disposed on the substrate 201 to desired thickness and set the thickness to uniform thickness, fluctuation of which is within fluctuation of the thickness of the flexible wiring board 204 at both ends. In order to transmit an ultrasonic wave while attenuating the ultrasonic wave, the silicone layer 205 is desirably set to uniform desired thickness. According to this embodiment, it is possible to form a silicone layer having uniform and desired thickness. Therefore, it is possible to provide a capacitance type transducer having a more uniform transmission and reception characteristic, having high reliability, and small in size.

Fifth Embodiment

A fifth embodiment is different from the first to fourth embodiments in that a part of the sheet 202 includes a recess. That is, the sheet 202 includes the recess on a plane formed by the surface of the sheet 202 and includes a cavity in a region where the CMUT 100 is disposed rather than in the vicinity of the frame 203. Otherwise, the fifth embodiment is the same as any one of the first to fourth embodiments. The fifth embodiment is described with reference to FIGS. 5A and 5B on the basis of the configuration in the fourth embodiment.

Figure 5A:
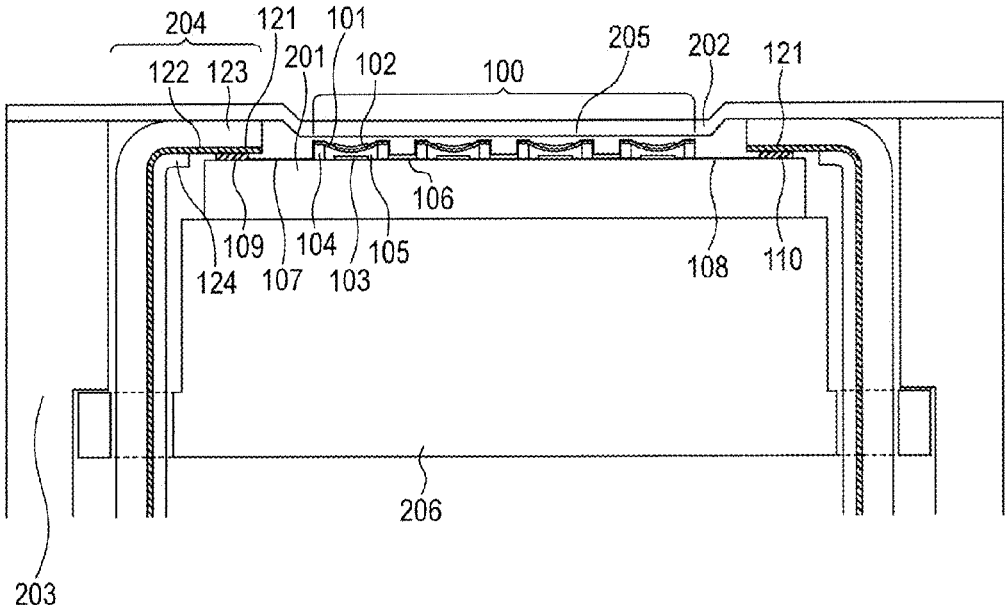
FIG. 5A is a diagram for describing a capacitance type transducer according to a fifth embodiment.

In this embodiment, the sheet 202 disposed on the region of the substrate 201, where the CMUT 100 configuring cells is formed, is further recessed to the substrate 201 side than the sheet 202 in the other region. In this embodiment, as illustrated in FIG. 5A, the silicone layer 205, which is the acoustic matching layer, on the substrate 201 has different thickness depending on a place. An enlarged diagram of a part of FIG. 5A is illustrated in FIG. 5B.

Figure 5B:
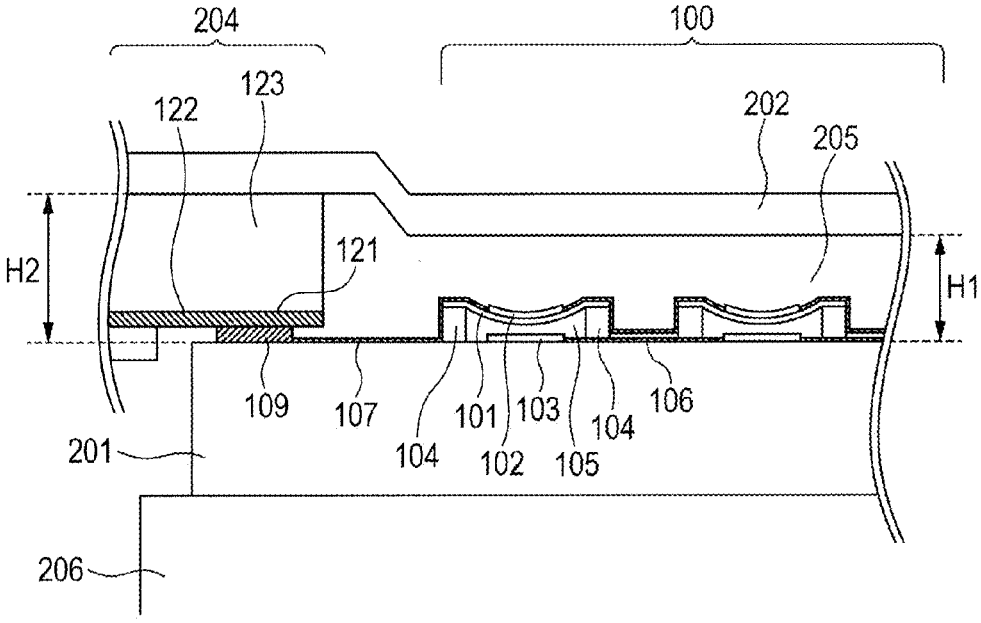
FIG. 5B is an enlarged diagram of a part of FIG. 5A.

Referring to FIG. 5B, thickness H1 of the silicone layer 205 is small on the region of the substrate 201 where the CMUT 100 is formed. Thickness H2 of the silicone layer 205 is large in the other region where an electric connection section electrically connected to the flexible wiring board 204 is disposed. That is, compared with the region where the CMUT 100 is disposed, the silicone layer 205 is formed thick on the outer side of the region. In the silicone layer 205, an ultrasonic wave is transmitted while being attenuated. Therefore, in order to avoid deterioration in a transmission and reception signal, it is desirable to use as thin the silicone layer 205 as possible.

In addition, resin such as PET (polyethylene terephthalate) is used as the sheet 202. Therefore, the acoustic impedance of the sheet 202 is different from the acoustic impedance of the silicone layer 205. Even small thickness of the sheet 202 is approximately several tens micrometers. The thickness is thickness that cannot be completely neglected with respect to wavelength at a frequency of several megahertz to ten megahertz in use. Therefore, reflection occurs in a part of a transmission and reception wave (an acoustic wave) on the interface between the silicone layer 205 and the sheet 202. The reflected wave causes deterioration in a frequency characteristic of an acoustic wave to be originally received by the CMUT 100 or an acoustic wave to be originally transmitted from the CMUT 100. Specifically, a characteristic at a frequency at which the thickness of the silicone layer 205 is equivalent to the wavelength of an acoustic wave in the silicone layer 205 is deteriorated by the reflected wave. Therefore, the thickness of the silicone layer 205 is desirably small compared with the wavelength of the acoustic wave used for transmission and reception. As a specific numerical value, in order to reduce an influence in a frequency range of 10 megahertz or less, it is desirable to set H1 to thickness of 24 micrometers or less. In order to reduce an influence in a frequency range of 6 megahertz or less, it is desirable to set H1 to thickness of 40 micrometers or less.

On the other hand, if the thickness H1 of the silicone layer 205 on the CMUT 100 is set too small, the sheet 202 is close to the CMUT 100. The radiation impedance of the CMUT 100 is affected by the sheet 202. A transmission and reception characteristic changes. Therefore, the thickness H1 of the silicone layer 205 on the CMUT 100 is desirably 20 micrometers or more.

Consequently, in a use of ultrasonic wave transmission and reception centering on a frequency of 8 megahertz used most in general, the thickness of the silicone layer 205 on the CMUT 100 is desirably in a range of 20 micrometers to 24 micrometers. In a use of ultrasonic wave transmission and reception centering on a relatively low frequency of 4 megahertz, the thickness of the silicone layer 205 is desirably in a range of 20 micrometers to 40 micrometers.

A lower limit of the distance between the surface of the substrate 201 and the lower surface of the sheet 202 is determined by the height of a wire draw-out section from the electrodes 109 and 110 on the substrate 201, specifically, the height of the sealing material 132 in the first embodiment and the thickness of the flexible wiring board 204 in the fourth embodiment.

In a form illustrated in FIG. 5B, the sealing material described in the first embodiment is not used. However, in this embodiment, it is also possible to use the sealing material. Since the sealing material needs to be disposed and hardened to cover a bonding wire, the thickness of the sealing material is approximately one hundred micrometers to three hundred micrometers. Since the flexible wiring board 204 is formed by sandwiching a metal thin film having thickness of approximately ten to forty micrometers with thick insulating films having thickness larger than fifteen micrometers, the thickness of the flexible wiring board 204 is approximately forty micrometers to one hundred micrometers. Therefore, in a configuration in which the sheet 202 does not include a recess, the thickness of the silicone layer 205 on the region where the CMUT 100 is disposed is equivalent to the height of the wire draw-out section.

Therefore, by using a configuration in which only the thickness of the silicone layer 205 on the CMUT 100 is reduced to provide a recess in this embodiment, it is possible to reduce only the thickness of the silicone layer 205 on the CMUT 100 without changing the wire draw-out section. Therefore, even in a configuration in which the sheet 202 having moisture resistance is disposed on the CMUT 100, it is possible to improve a deterioration characteristic during ultrasonic wave transmission in the portions of the sheet 202 and the silicone layer 205 in the region of the CMUT 100 that performs transmission and reception of an ultrasonic wave. Therefore, it is possible to obtain an excellent transmission and reception characteristic.

According to this embodiment, since it is possible to reduce the thickness H1 of the silicone layer 205 on the CMUT 100, deterioration of a transmission and reception ultrasonic wave in a sheet section is small. Therefore, it is possible to provide a capacitance type transducer further excellent in a transmission and reception characteristic, having high reliability, and small in size.

Sixth Embodiment

A sixth embodiment is different from the first to fifth embodiments in a place where the electrodes 109 and 110 are disposed on the substrate 201. Otherwise, the sixth embodiment is the same as any one of the first to fifth embodiments. The sixth embodiment is described with reference to FIGS. 6A and 6B on the basis of the configuration in the fourth embodiment.

Figure 6A:
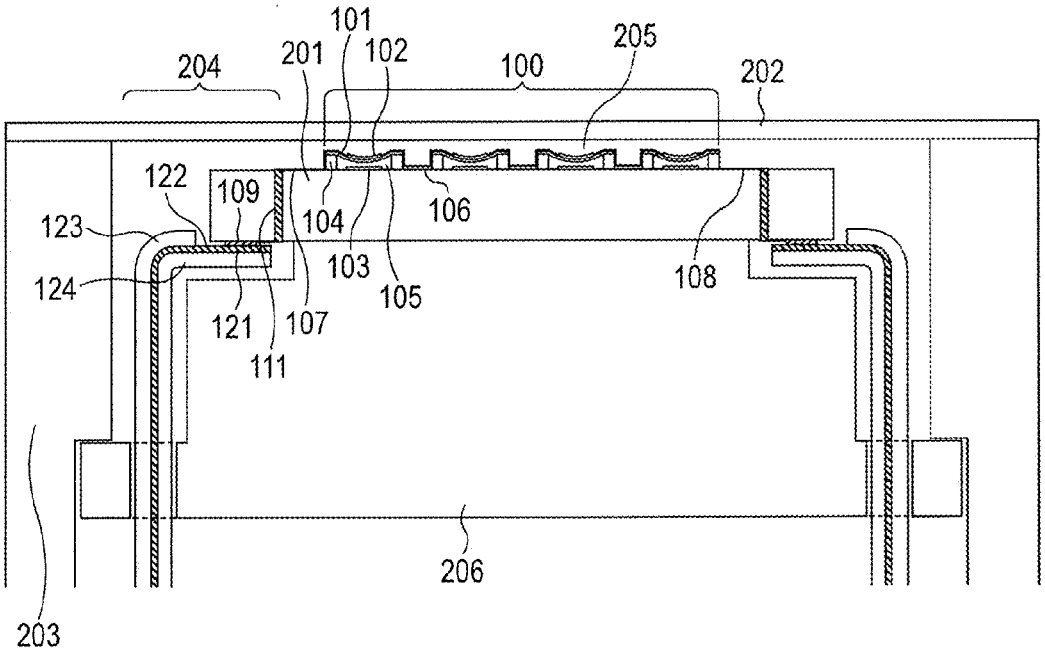
FIGS. 6A and 6B are diagrams for describing a capacitance type transducer according to a sixth embodiment.

In this embodiment, the electrodes 109 and 110 are disposed on a surface on the opposite side of the surface on which the CMUT 100 is formed on the substrate 201. As illustrated in FIG. 6A, the wires 107 and 108 are drawn out, via a through-wire 111 that electrically connects both surfaces of the substrate 201, to a substrate surface side on which the CMUT 100 is not formed from a substrate surface on which the CMUT 100 is formed. The wires drawn out to the substrate surface side on which the CMUT 100 is not formed are connected to the electrode 109 and electrically connected to the flexible wiring board 204. In FIG. 6A, the wires are connected using ACF resin. The flexible wiring board 204 is disposed on the substrate surface (the rear surface) of the substrate 201 on which the CMUT 100 is not formed.

In this embodiment, since the flexible wiring board 204 is absent on the CMUT 100 formation surface side of the substrate 201, there is no limitation in setting the surface of the substrate 201 and the lower surface of the sheet 202 close to each other. Therefore, the thickness of the silicone layer 205 can be reduced to thickness that does not cause a problem in mechanically fixing the substrate 201 and the sheet 202. Therefore, it is possible to reduce attenuation of an ultrasonic wave transmitted through the silicone layer 205 to be extremely small and reduce deterioration in a transmission and reception characteristic in the silicone layer 205 to be extremely small. Since only the CMUT 100 is disposed on the surface of the substrate 201, deterioration in the transmission and reception characteristic due to irregular reflection of an ultrasonic wave due to a wire near the substrate 201 does not occur. It is possible to obtain a satisfactory transmission and reception characteristic.

Note that, in this embodiment, the distance between the surface of the substrate 201 and the lower surface of the sheet 202 can be set to a desired value by defining the position of the substrate 201 and the position of the frame 203 using the recess of the frame 203 and the projection of the supporting member 206. According to this embodiment, it is possible to provide a capacitance type transducer extremely excellent in a transmission and reception characteristic, having high reliability, and small in size.

Figure 6B:
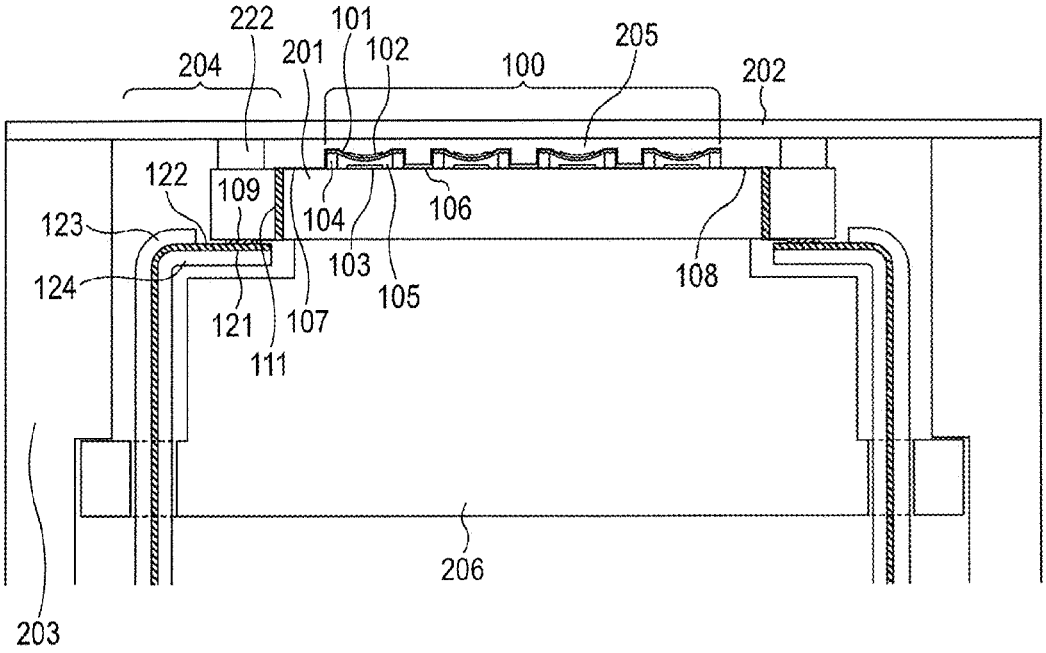

Another form of this embodiment is described with reference to FIG. 6B. In FIG. 6B, a pair of spacers 222 are disposed on an end face of a substrate in a region where the CMUT 100 is not formed on the substrate 201. As the spacers 222, spacers having thickness same as a desired thickness of the silicone layer 205 are used. By adopting this configuration, compared with a configuration in which a distance relation between the substrate 201 and the sheet 202 is determined by the frame 203 and the supporting member 206, since a distance can be determined by only the spacers 222, it is possible to more highly accurately determine the distance between the substrate 201 and the sheet 202. Since any thickness (e.g., several micrometers to several tens micrometers) can be selected as the thickness of the spacers 222, it is possible to set the thickness of the silicone layer 205 small and highly accurate. Therefore, it is possible to reduce attenuation of an ultrasonic wave transmitted through the silicone layer 205 to be extremely small and reduce deterioration in a transmission and reception characteristic to be extremely small and uniform. According to this form, it is possible to provide a capacitance type transducer extremely excellent in a transmission and reception characteristic, having high reliability, and small in size.

Seventh Embodiment

Figure 7A:
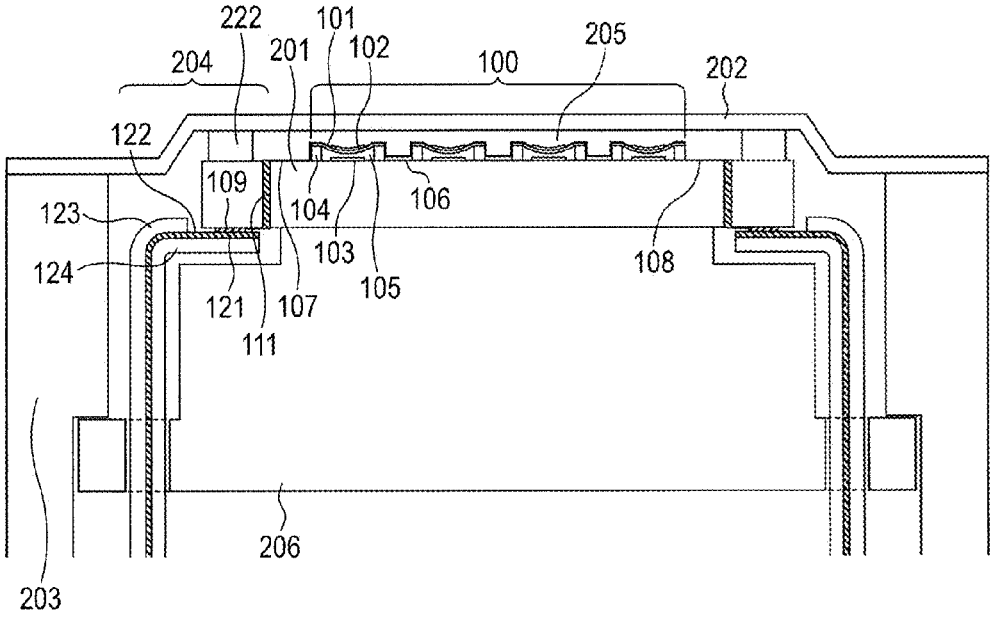
FIGS. 7A and 7B are diagrams for describing a capacitance type transducer according to a seventh embodiment.
Figure 7B:
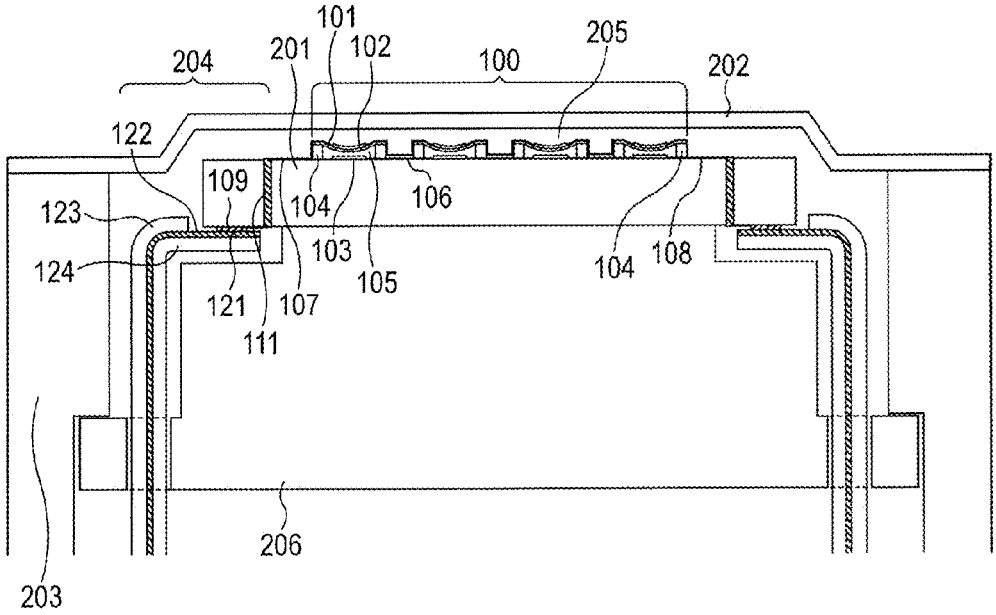

A seventh embodiment is different from the first to sixth embodiments in that a part of the sheet 202 includes a projection. Otherwise, the seventh embodiment is the same as any one of the first to sixth embodiments. The seventh embodiment is described with reference to FIGS. 7A and 7B on the basis of the configuration in the sixth embodiment.

In this embodiment, the surface of the substrate 201 on which the CMUT 100 is formed is disposed to further project to the outer side than the end face of the frame 203. Therefore, the surface of the sheet 202 in a region on the substrate 201 is disposed farther on the outer side of a transducer than the surface of the sheet 202 in a region on the frame 203 by the thickness of the silicone layer 205. With this configuration, the CMUT 100 is disposed further on the outer side than the end face of the frame 203, in other words, on the side of a measurement target (not illustrated in the figure), which is a subject that transmits and receives an ultrasonic wave. Therefore, when an ultrasonic wave is transmitted from the CMUT 100, it is possible to substantially neglect the fact that the transmitted ultrasonic sound is reflected on the end face of the frame 203 and a transmission waveform of the ultrasonic wave reaching the measurement target is deteriorated. When the CMUT 100 receives the ultrasonic wave from the measurement target, even if a received wave is reflected on the end face of the frame 203, the reflection can be substantially neglected in a signal received in the CMUT 100. In this way, in this embodiment, the surface of the substrate 201, on which the CMUT 100 is formed, is disposed further on the outer side than the end face of the frame 203. Therefore, it is possible to reduce the influence of the frame 203 on the ultrasonic wave during transmission and reception to be extremely small. It is possible to provide a capacitance type transducer extremely excellent in a transmission and reception characteristic, having high reliability, and small in size.

Note that this embodiment is described on the basis of the sixth embodiment. However, this embodiment is not limited to the sixth embodiment. This embodiment can also be applied to a configuration in which the wire 131 is disposed on the substrate 201 in the first embodiment or the flexible wiring board 204 is disposed on the substrate 201 in the fourth embodiment. It is possible to obtain the same effects.

Eighth Embodiment

Figure 8:
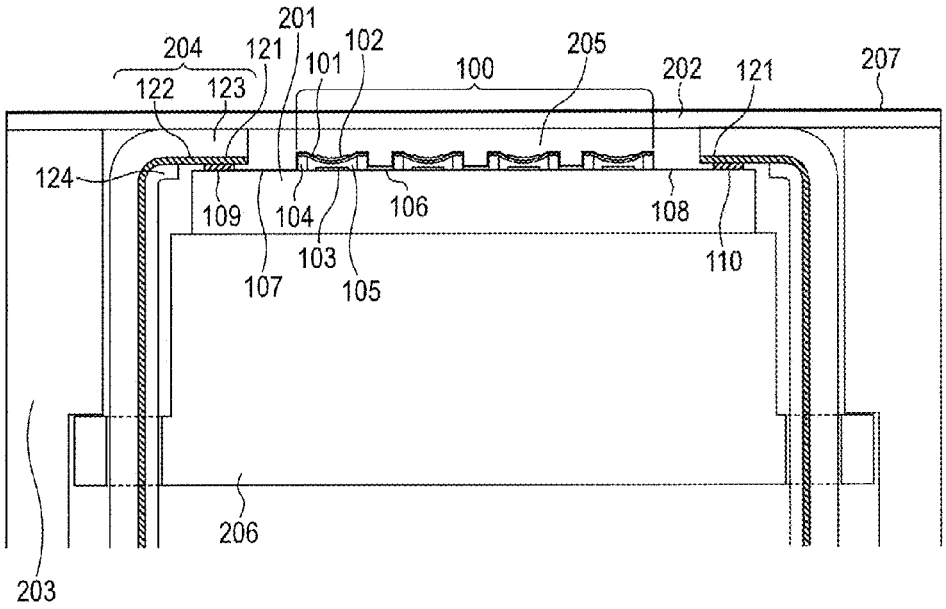
FIG. 8 is a diagram for describing a capacitance type transducer according to an eighth embodiment.

An eighth embodiment is different from the first to seventh embodiments in the surface of the sheet 202. Otherwise, the eighth embodiment is the same as any one of the first to seventh embodiments. The eighth embodiment is described with reference to FIG. 8 on the basis of the configuration in the fourth embodiment.

In this embodiment, a reflecting film 207 that reflects specific light is provided on the surface of the sheet 202. When pulse light is irradiated on a measurement target and a generated photoacoustic wave is received by a transducer, the photoacoustic wave is generated in the transducer and a reception characteristic is deteriorated when the irradiated pulse light reaches the transducer as well. In this embodiment, the reflecting film 207 that reflects pulse light is provided. The sheet 202 having low water vapor permeability is also used as a member that holds the reflecting film 207. Therefore, it is possible to realize the transducer with a simple layer configuration. Therefore, since the number of layers through which the ultrasonic wave is transmitted can be reduced, it is possible to reduce deterioration in an ultrasonic waveform received by the CMUT 100.

The reflecting film 207 in this embodiment is a member for suppressing incidence of light on the CMUT 100. Specifically, the reflecting film 207 is a member for reflecting irradiated light to a subject or scattered light of the irradiated light. When an organism such as a breast is diagnosed as the subject, a near infrared region having a wavelength of 700 nm or more and 1000 nm or less is often used as a laser beam. The reflecting film 207 preferably has high reflectance (reflectance of preferably 80% or more and more preferably 90% or more) with respect to light in a wavelength region in use (e.g., 700 nm to 1000 nm). Specifically, the reflecting film 207 is preferably formed of a metal thin film. Metal containing at least one element among Au, Ag, Al, and Cu and an alloy of these kinds of metal can be used.

The thickness of the reflecting film 207 is preferably 150 nm or more. If the thickness is 150 nm or more, sufficient reflectance can be obtained. However, the thickness can be set to 10 μm or less taking into account acoustic impedance. For example, in the case of Au, since the acoustic impedance is as high as approximately 63×106 [$kg \cdot m^{-2} \cdot s^{-1}$], it is necessary to reduce the thickness to a certain degree in order to prevent reflection of an acoustic wave due to acoustic impedance mismatching. Therefore, in the case of Au, the thickness can be set to 1/30 or less of the wavelength of an acoustic wave in the material. In particular, taking into account the fact that a reception band of an acoustic wave generated by a photoacoustic effect is usually approximately 10 MHz and wavelength in water at 10 MHz is approximately 150 μm, the thickness of the Au film can be set to 5 μm or less. As a method of forming the reflecting film 207, vapor deposition or sputtering can be used. A base layer of Cr or Ti may be provided to increase adhesion.

As the reflecting film 207, not only the metal film but also a dielectric multilayer film can be used. Further, the reflecting film 207 can also be a stacked structure obtained by forming the dielectric multilayer film on the metal film. Such a stacked structure can be adopted because reflectance can be further improved. According to this embodiment, it is possible to provide a capacitance type transducer having high reliability, small in size, and excellent in a transmission and reception characteristic even when the capacitance type transducer is used for reception of a photoacoustic wave.

Ninth Embodiment

A ninth embodiment is different from the first to eighth embodiments in that a member is disposed on the outer side of a transducer. Otherwise, the ninth embodiment is the same as any one of the first to eighth embodiments. The ninth embodiment is described with reference to FIG. 9 on the basis of the configuration in the fourth embodiment.

Figure 9:
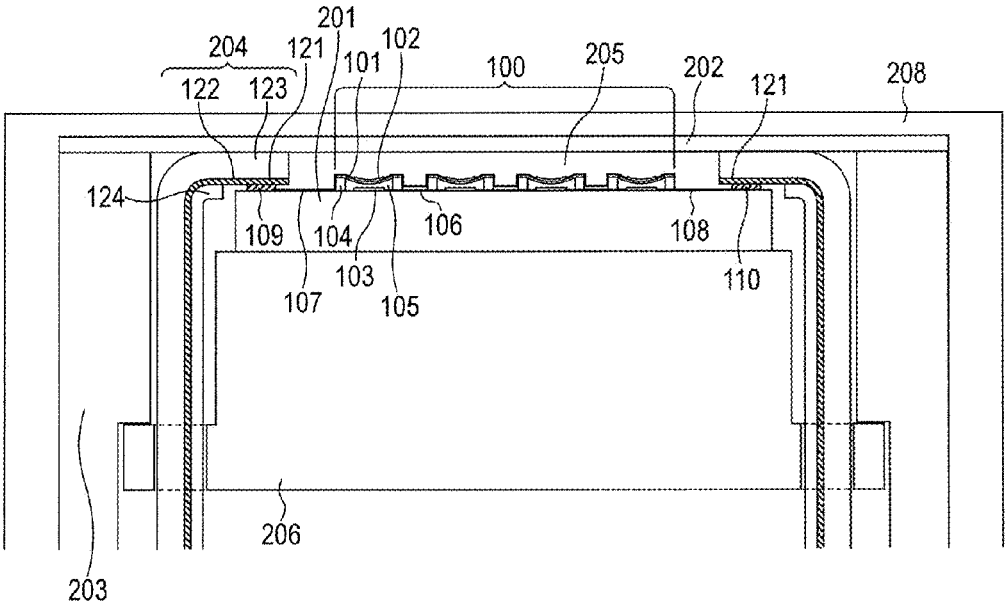
FIG. 9 is a diagram for describing a capacitance type transducer according to a ninth embodiment.

In this embodiment, a resin cover 208 is provided on the sheet 202 of the transducer. Since the transducer includes the resin cover 208, even when a shock is applied from the outside, it is possible to prevent the shock from being transmitted to the sheet 202 and prevent the sheet 202 from being damaged. Therefore, it is possible to prevent a situation in which the sheet 202 is damaged, intrusion of moisture from the outside occurs, and a wire is corroded. As the resin cover 208, any resin cover can be used as long as the resin cover has resistance against a shock from the outside and abrasion. A material such as silicone resin or plastics having necessary thickness can be used as long as a problem does not occur in deterioration in a transmission and reception characteristic of an ultrasonic wave. As illustrated in FIG. 9, the resin cover 208 is not limitedly disposed on the sheet 202 and may be contiguously disposed in a part of the side surface of the frame 203 as well. The resin cover 208 is bonded to the sheet 202 and the frame 203 by an adhesive. The adhesive may be any adhesive as long as the adhesive affects a transmission and reception characteristic of an ultrasonic wave little and has sufficient bonding strength.

According to this embodiment, it is possible to provide a capacitance type transducer robust against a shock from the outside, having high reliability, small in size, and excellent in a transmission and reception characteristic.

Tenth Embodiment

Figure 10:
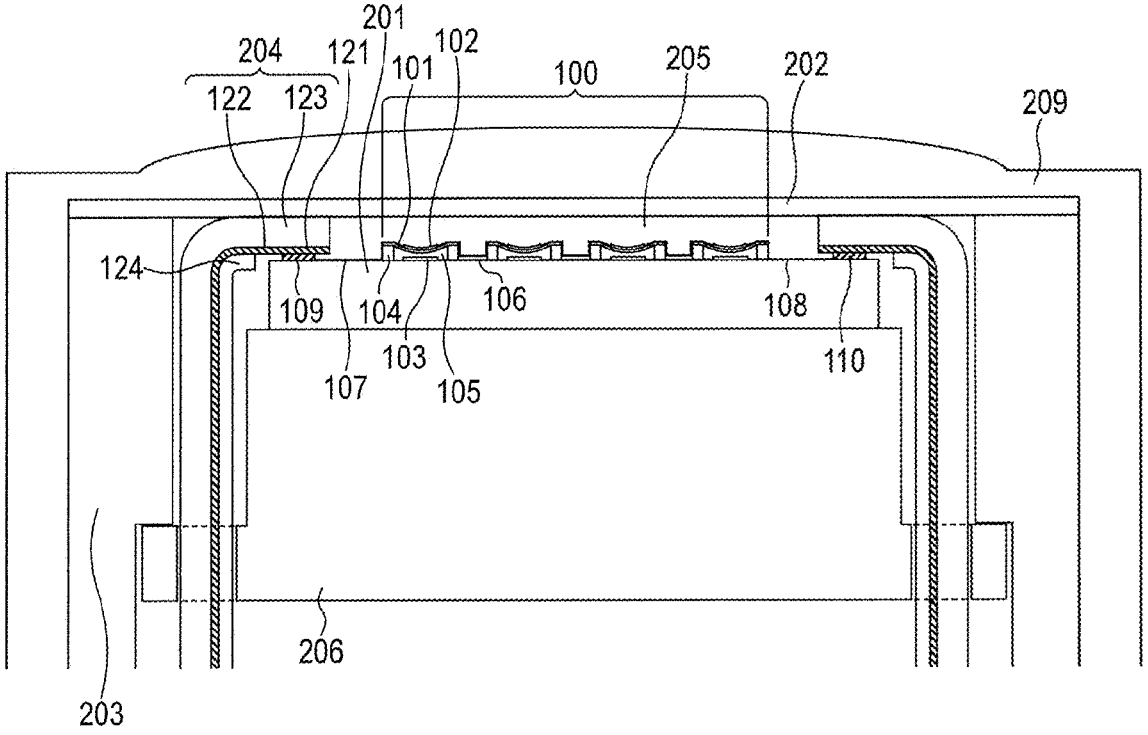
FIG. 10 is a diagram for describing a capacitance type transducer according to a tenth embodiment.

A tenth embodiment is different from the first to ninth embodiments in that a member is disposed on the outer side of a transducer. Otherwise, the tenth embodiment is same as any one of the first to eighth embodiments. The tenth embodiment is described with reference to FIG. 10 on the basis of the configuration in the fourth embodiment.

In this embodiment, an acoustic lens 209 is provided on the sheet 202 of the transducer. By using the acoustic lens 209, concerning a transmission waveform of an ultrasonic wave, it is possible to increase intensity in a certain range at a specific distance. Similarly, concerning reception, it is possible to receive, at high sensitivity, a reception waveform from a certain range at a specific distance. The acoustic lens 209 is molded using silicone having high water vapor permeability and bonded on the sheet 202. According to this embodiment, since the CMUT 100 on the substrate 201 is surrounded by the sheet 202 having low water vapor permeability and the frame 203, corrosion of a wiring section less easily occurs.

It is desirable to adopt a configuration in which the acoustic impedance of the sheet 202 and the acoustic impedance of the acoustic lens 209 are set as close as possible and reflection less easily occurs on the interface between the sheet 202 and the acoustic lens 209. However, the acoustic lens 209 has a limitation due to a medium in contact with the surface of the acoustic lens 209 and a limitation on acoustic impedance peculiar to a sheet material. It is difficult to completely match the acoustic impedance of the sheet 202 and the acoustic impedance of the acoustic lens 209. On the interface between the sheet 202 and the acoustic lens 209, reflection of the ultrasonic wave occurs to easily deteriorate a transmission characteristic of the ultrasonic wave. When the sheet 202 is disposed on the surface of the acoustic lens 209, an interface on which reflection occurs is different depending on a distance of a portion on a curved surface of the acoustic lens 209 from the CMUT 100. The portion on the curved surface is away from the CMUT 100 by a distance equal to or larger than the thickness of the lens. The distance is set to be sufficiently large with respect to the wavelength of an ultrasonic wave in use. Therefore, the distance greatly affects a transmission characteristic during transmission and reception. However, according to this embodiment, compared with a configuration in which the sheet 202 is disposed on the surface of the acoustic lens 209, it is possible to substantially reduce the distance between the substrate 201, on which the CMUT 100 is formed, and the sheet 202. Therefore, a place where reflection occurs can be set in a place at an equal distance from the CMUT 100 and a distance sufficiently shorter than the wavelength of the ultrasonic wave. Therefore, it is possible to reduce the influence on the transmission characteristic during transmission and reception.

According to this embodiment, even in the configuration including the acoustic lens, it is possible to provide a capacitance type transducer having high reliability, small in size, and excellent in a transmission and reception characteristic. Note that, in the fifth to tenth embodiments, the electrodes 109 and 110 on the substrate 201 and the electrode 121 on the flexible wiring board 204 is described as being connected using the ACF resin functioning as the electric connection means. However, in these embodiments, the electric connection means is not limited to the ACF resin. Any electric connection means such as electric connection means by a wire which is described in the first embodiment can be applied as long as electric connection between electrodes can be performed.

Eleventh Embodiment

In this embodiment, a manufacturing method for the capacitance type transducer according to any one of the first to tenth embodiments is described.

In the manufacturing method in this embodiment, after a process for fixing the substrate 201, on which the CMUT 100 is formed, and the sheet 202 using the silicone layer 205, a process for bonding the sheet 202 to the end face of the frame 203 is executed. The manufacturing processes are specifically described with reference to FIGS. 11A to 11E. In the figures for describing the manufacturing processes, the CMUT 100 on the substrate 201 is omitted. However, actually, the CMUT 100 is formed on a surface on the upper side on the figure of the substrate 201. Actually, the frame 203 and the supporting member 206 have complicated structures as illustrated in the figures such as FIG. 1A. However, in the figures for describing the manufacturing processes, uneven sections actually included in frame 203 and the supporting member 206 are omitted. The frame 203 and the supporting member 206 are illustrated in simple configurations. In the figures for describing the manufacturing processes, the flexible wiring board 204 is omitted except when the flexible wiring board 204 is necessary in description.

Figure 11A:
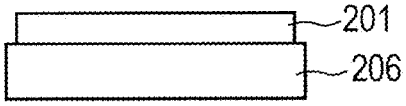
FIGS. 11A, 11B, 11C, 11D, and 11E are diagrams of a manufacturing method for a capacitance type transducer according to an eleventh embodiment.
Figure 11B:
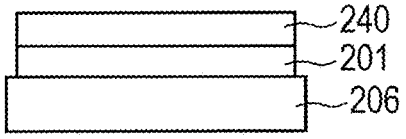

First, the CMUT 100 is formed on the substrate 201. Thereafter, the substrate 201 is stuck on the supporting member 206 (FIG. 11A). This process can be easily carried out by using, for example, a technique called die-bonding for sticking a chip of an integrated circuit. Subsequently, unhardened silicone resin 240 is applied on the substrate 201 (FIG. 11B). Local application on the substrate 201 can be easily performed by using a dispenser. As the silicone resin 240, both of cold-curing silicone resin and thermal-curing silicone resin can be used. When the cold-curing type resin is used, the silicone resin 240 can be properly applied by carrying out the process in time shorter than hardening time.

Figure 11C:
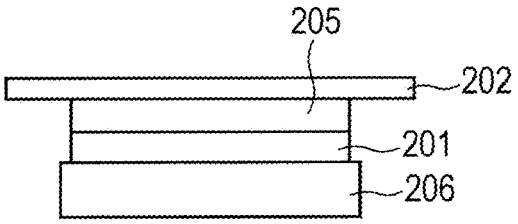

Subsequently, the sheet 202 is fixed, the substrate 201 is brought close to the sheet 202, and the upper surface of the unhardened silicone resin 240 on the substrate 201 and the lower surface of the sheet 202 are brought into contact with each other. In this case, the substrate 201 is stopped in a position where the distance between the sheet 202 and the substrate 201 is a predetermined distance. The position where the substrate 201 is stopped can be easily determined by adjusting, with a fine motion stage, a positional relation between a portion where the sheet 202 is fixed and a portion where the supporting member 206 is held. Thereafter, the silicone resin 240 is hardened and the substrate 201 and the sheet 202 are fixed by the hardened silicone layer 205 (FIG. 11C). In both of the cold-curing silicone resin and the thermal-curing silicone resin, the positional relation between the substrate 201 and the sheet 202 is kept fixed until the hardening is completed.

Figure 11D:
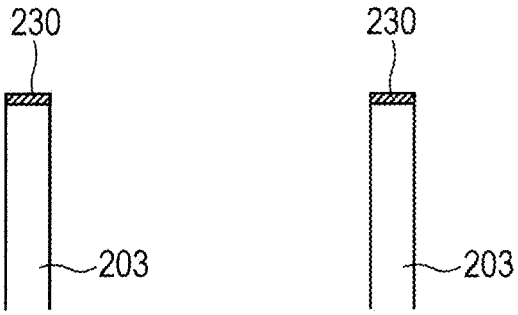

Subsequently, the unhardened adhesive 230 is applied to the end face of the frame 203 (FIG. 11D). Local application on the end face of the frame 203 can be easily performed by using a dispenser. As the adhesive 230, any adhesive can be used as long as the sheet 202 and the frame 203 can be bonded. The adhesive 230 can be easily formed from an epoxy adhesive. Note that, in order to improve adhesive strength between the adhesive 230 and one of the sheet 202 and the frame 203, the surface of one of the sheet 202 and the frame 203 can also be subjected to priming. As a primer, it is desirable to use low-viscosity liquid for facilitating bonding of the surface and more suitable for a type of the adhesive 230. After the primer is applied, a solvent is volatilized to perform heat treatment for fixing and the adhesive 230 is applied.

Figure 11E:
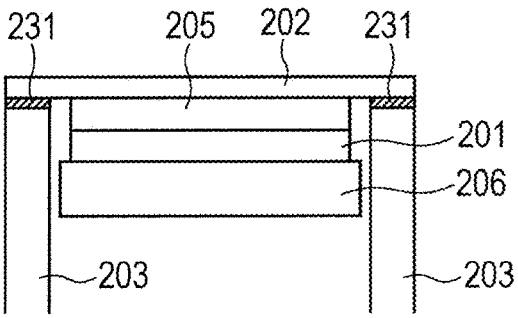

Finally, the substrate 201 and the fixed sheet 202 are brought close to the frame 203. The substrate 201 and the fixed sheet 202 are stopped in a state in which the lower surface of the sheet 202 is set in contact with the end face of the frame 203 to which the adhesive 230 is applied. The adhesive 230 is hardened (FIG. 11E). Consequently, the sheet 202 and the frame 203 are fixed by the hardened adhesive 231.

Note that, in the figures for describing the manufacturing processes, the substrate 201 is held by the frame 203 via the sheet 202. However, the present invention is not limited to this. Actually, it is desirable to fix the substrate 201 and the frame 203 using an adhesive. In addition, if a recess (or a projection) is provided in the frame 203 and a projection (or a recess) is provided in the supporting member 206 and bonding is performed in a portion where the projection and the recess are fit with each other, it is possible to fix the frame 203 and the supporting member 206 with higher mechanical strength. It is possible to improve reliability.

Twelfth Embodiment

In this embodiment as well, a manufacturing method for the capacitance type transducer described in any one of the first to tenth embodiments is described. In the manufacturing method in this embodiment, a process for fixing the substrate 201, on which the CMUT 100 is formed, and the sheet 202 using a silicone layer and a process for bonding the sheet 202 to the end face of the frame 203 are simultaneously performed. The manufacturing processes are specifically described with reference to FIGS. 12A to 12F.

Figure 12A:
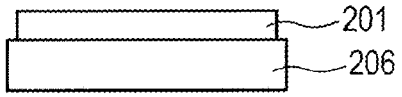
FIGS. 12A, 12B, 12C, 12D, 12E, and 12F are diagrams of a manufacturing method for a capacitance type transducer according to a twelfth embodiment.
Figure 12B:
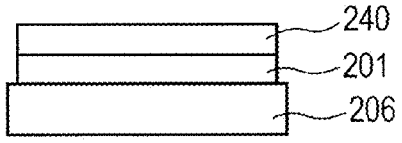

First, the CMUT 100 is formed on the substrate 201. Thereafter, the substrate 201 is stuck on the supporting member 206 (FIG. 12A). This process can be easily carried out by using, for example, a technique called die-bonding for sticking a chip of an integrated circuit. Subsequently, the unhardened silicone resin 240 is applied on the substrate 201 (FIG. 12B). Local application on the substrate 201 can be easily performed by using a dispenser. As the silicone resin 240, both of cold-curing silicone resin and thermal-curing silicone resin can be used. When the cold-curing type resin is used, the silicone resin 240 can be properly applied by carrying out the following process in time shorter than hardening time.

Figure 12C:
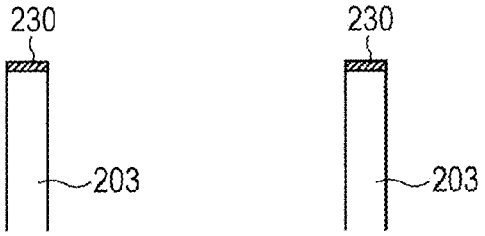
Figure 12D:
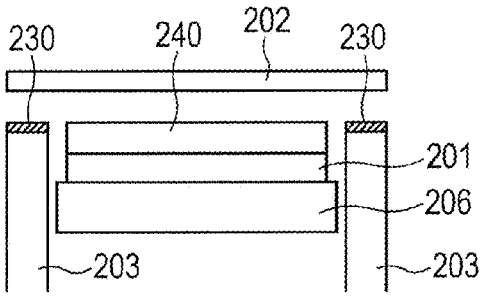

Subsequently, the unhardened adhesive 230 is applied to the end face of the frame 203 (FIG. 12C). Local application on the end face of the frame 203 can be easily performed by using a dispenser. As the adhesive 230, any adhesive can be used as long as the sheet 202 and the frame 203 can be bonded. The adhesive 230 can be easily formed from an epoxy adhesive. Note that, in order to improve adhesive strength between the adhesive 230 and one of the sheet 202 and the frame 203, the surface of one of the sheet 202 and the frame 203 can also be subjected to priming.

Figure 12E:
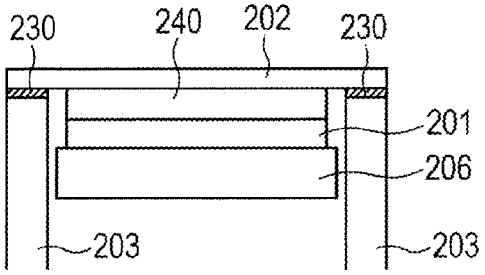
Figure 12F:
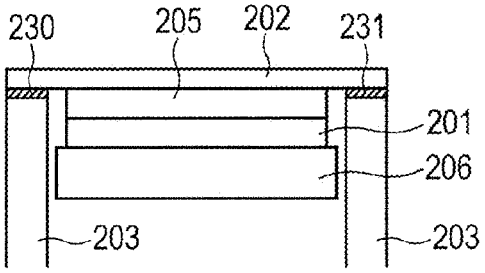

Subsequently, the sheet 202 is fixed, the frame 203 is brought close to the sheet 202 side (FIG. 12D), and the surface of the unhardened adhesive 230 on the end face of the frame 203 and the lower surface of the sheet 202 are brought into contact with each other to be set to predetermined thickness. At the same time, the substrate 201 is brought close to the sheet 202 side and the surface of the unhardened silicone resin 240 on the substrate 201 and the lower surface of the sheet 202 are brought into contact with each other (FIG. 12E). In this case, the substrate 201 is stopped in a position where the distance between the sheet 202 and the substrate 201 is a predetermined distance. The position where the substrate 201 is stopped can be easily determined by adjusting, with a fine motion stage, a positional relation between a portion where the sheet 202 is fixed and a portion where the supporting member 206 is held. Thereafter, the adhesive 230 and the silicone resin 240 are simultaneously hardened. The frame 203 and the sheet 202 are fixed by the hardened adhesive 231. The substrate 201 and the sheet 202 are fixed by the hardened silicone layer 205 (FIG. 12F).

According to this embodiment, since the hardening of the adhesive 230 and the hardening of the silicone resin 240 are performed in the same process, it is possible to realize simplification of the processes and a reduction in a process time. Note that, in the above description, the frame 203 is brought close to the sheet 202 first and, then, the substrate 201 is brought close to the sheet 202. However, this embodiment is not limited to this procedure. The opposite procedure can also be adopted. It is also possible to simultaneously bring the frame 203 and the substrate 201 close to the sheet 202 side. Consequently, it is possible to realize simplification of the processes and standardization of a jig.

Thirteenth Embodiment

In this embodiment, a manufacturing method for the capacitance type transducer described in any one of the first to tenth embodiments is described. In the manufacturing method in this embodiment, after a process for bonding the sheet 202 to the end face of the frame 203, a process for fixing the substrate 201, on which the CMUT 100 is formed, and the sheet 202 using the silicone layer 205 is performed. The manufacturing processes are specifically described with reference to FIGS. 13A to 13H.

Figure 13A:
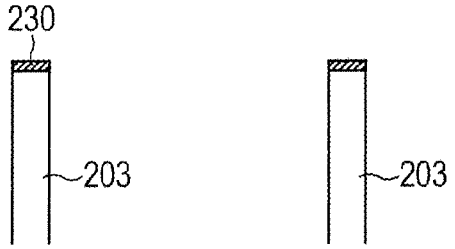
FIGS. 13A, 13B, 13C, 13D, 13E, 13F, 13G, and 13H are diagrams of a manufacturing method for a capacitance type transducer according to a thirteenth embodiment.
Figure 13B:
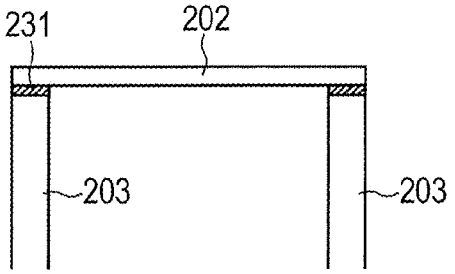

First, the unhardened adhesive 230 is applied to the end face of the frame 203 (FIG. 13A). Local application on the end face of the frame 203 can be easily performed by using a dispenser. As the adhesive 230, any adhesive can be used as long as the sheet 202 and the frame 203 can be bonded. The adhesive 230 can be easily formed from an epoxy adhesive. Note that, in order to improve adhesive strength between the adhesive 230 and one of the sheet 202 and the frame 203, the surface of one of the sheet 202 and the frame 203 can also be subjected to priming. Subsequently, the sheet 202 is fixed, the frame 203 is brought close to the sheet 202 side, and the surface of the unhardened adhesive 230 on the end face of the frame 203 and the lower surface of the sheet 202 are brought into contact with each other to be set to predetermined thickness. Thereafter, the adhesive 230 is hardened. The frame 203 and the sheet 202 are fixed by the hardened adhesive 231 (FIG. 13B).

Figure 13C:
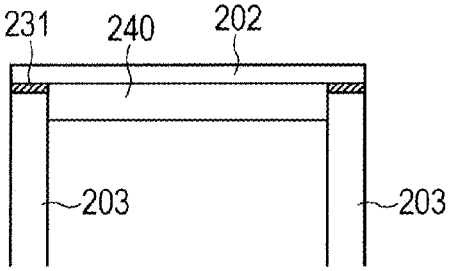

Subsequently, the unhardened silicone resin 240 is applied to a region surrounded by the frame 203 and the sheet 202. The inside of the region is filled with the silicone resin 240 (FIG. 13C). The application can be easily and quantitatively performed by using a dispenser. As the silicone resin 240, both of cold-curing silicone resin and thermal-curing silicone resin can be used. When the cold-curing type resin is used, the silicone resin 240 can be properly applied by carrying out the following process in time shorter than hardening time.

Figure 13D:
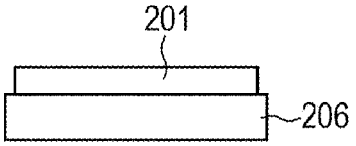
Figure 13E:
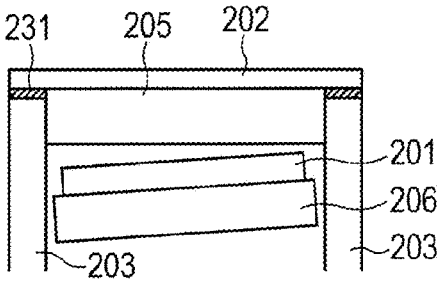
Figure 13F:
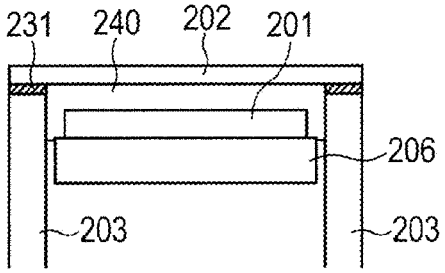

Thereafter, the CMUT 100 is formed on the substrate 201. Thereafter, the substrate 201 is stuck on the supporting member 206 (FIG. 13D). This process can be easily carried out by using, for example, a technique called die-bonding for sticking a chip of an integrated circuit. Subsequently, the substrate 201 is inclined a little with respect to the sheet 202. While an angle of the inclination is kept, the substrate 201 is immersed in the region surrounded by the frame 203 and the sheet 202 and applied with the silicone resin 240 (FIG. 13E). When the surface of the substrate 201 is entirely immersed in the silicone, the substrate 201 is returned to be parallel to the sheet 202. The distance between the sheet 202 and the substrate 201 is reduced (FIG. 13F).

Figure 13G:
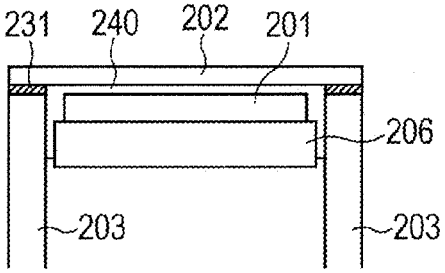
Figure 13H:
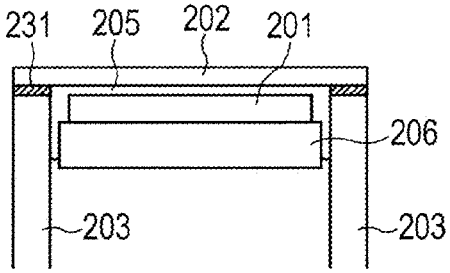

Finally, the substrate 201 is stopped in a position where the distance between the sheet 202 and the substrate 201 is a predetermined distance (FIG. 13G). The position where the substrate 201 is stopped can be easily determined by adjusting, with a fine motion stage, a positional relation between a portion where the sheet 202 is fixed and a portion where the supporting member 206 is held. Thereafter, the silicone resin 240 is hardened and the substrate 201 and the sheet 202 are fixed by the hardened silicone layer 205 (FIG. 13H). In that case, a part of the silicone layer 205 flows into between the frame 203 and the substrate 201 and the supporting member 206 and hardens. A range in which the silicone layer 205 hardens can be adjusted by first adjusting an amount of the silicone layer 205 to be applied. The silicone layer 205 hardened between the frame 203 and the substrate 201 and the supporting member 206 also functions as an adhesive for mechanically holding the frame 203 and the substrate 201 and the supporting member 206. This leads to improvement of reliability.

In general, the unhardened silicone resin 240 has high viscosity and tends to entrap the air. If an air layer remains in the silicone layer 205, when an ultrasonic wave is transmitted through the silicone layer 205, large attenuation of the ultrasonic wave is caused by a difference between the acoustic impedance of the silicone layer 205 and the acoustic impedance of the air layer. In the process for applying the silicone resin 240 on the substrate 201 and then sticking the sheet 202 described in the eleventh and twelfth embodiments, the air tends to be entrapped in the silicone resin 240. To avoid the entrapment of the air, a complicated process is sometimes necessary to, for example, perform the sticking process in a decompressed atmosphere or stick the sheet 202 using a roll. On the other hand, according to this embodiment, since the substrate 201 is obliquely immersed in the region surrounded by the frame 203 and the sheet 202 and filled with the silicone resin 240, the air is less easily entrapped in the silicone resin 240. Therefore, it is possible to prevent the formation of the air layer in the silicone layer 205 between the sheet 202 and the substrate 201 in a simple process without using a complicated process. It is possible to manufacture a capacitance type transducer excellent in a transmission and reception characteristic.

Fourteenth Embodiment

This embodiment relates to a process for fixing the substrate 201, on which the CMUT 100 is formed, and the sheet 202 via the silicone layer 205. Otherwise, a manufacturing process in this embodiment is the same as the manufacturing process described in any one of the eleventh to thirteenth embodiments. In this embodiment, the thickness of the silicone layer 205 is defined by a thickness setting section disposed on the substrate 201. Processes are specifically described with reference to FIGS. 14A to 14H.

Figure 14A:
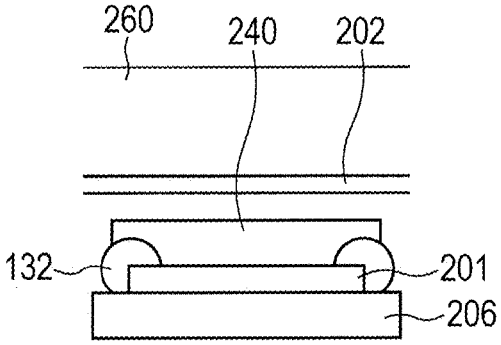
FIGS. 14A, 14B, 14C, 14D, 14E, 14F, 14G, and 14H are diagrams of a manufacturing method for a capacitance type transducer according to a fourteenth embodiment.

First, the sheet 202 is fixed to a holding jig 260 having a flat surface. At this point, the sheet 202 is held flat along the surface shape of the holding jig 260. As the holding jig 260, metal or resin can be used as long as deformation is not caused in the substrate 201 by external force applied to the substrate 201. Subsequently, the substrate 201 applied with the unhardened silicone resin 240 is brought close to the sheet 202. On the substrate 201, a determined member (the thickness setting section) determined at predetermined height is disposed in order to define the height between the sheet 202 and the substrate 201. In FIG. 14A, the sealing material 132, which seals the wire 131, is used.

Figure 14D:
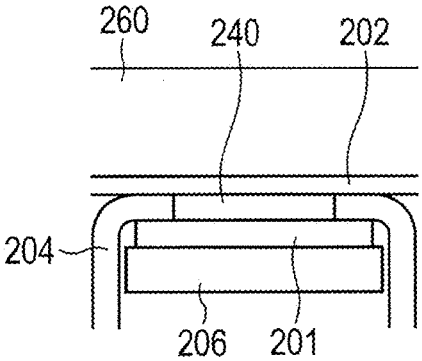
Figure 14B:
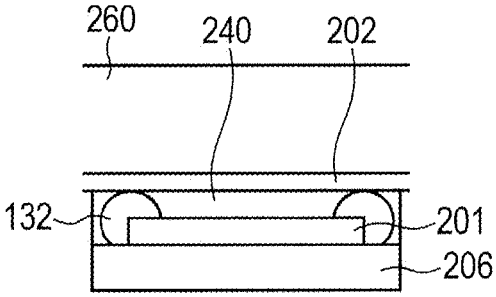

When the substrate 201 is further brought close to the sheet side, the silicone resin 240 on the substrate 201 comes into contact with the lower surface of the sheet 202. When the substrate 201 and the sheet 202 are continuously brought close to each other, the sealing material 132 comes into contact with the lower surface of the sheet 202. The distance between the substrate 201 and the sheet 202 does not decrease anymore. The movement of the substrate 201 is stopped (FIG. 14B). Consequently, the thickness of the silicone resin 240 present between the substrate 201 and the sheet 202 is the same as the height of the sealing material 132, which is the thickness setting section. Means for stopping the movement of the substrate 201 can be easily realized by a configuration for applying fixed external force to the substrate 201 using a spring. Finally, by hardening the silicone resin 240 in this state, it is possible to fix the substrate 201 and the sheet 202 using the silicone layer 205 while keeping the distance between the substrate 201 and the sheet 202 the same as the height of the sealing material 132.

In this embodiment, the distance between the sheet 202 and the substrate 201 is defined by the thickness setting section disposed on the substrate 201. Therefore, compared with when the height is defined by a movable stage or fitting of a frame and a supporting member, it is possible to more accurately define the distance between the sheet 202 and the substrate 201.

Figure 14E:
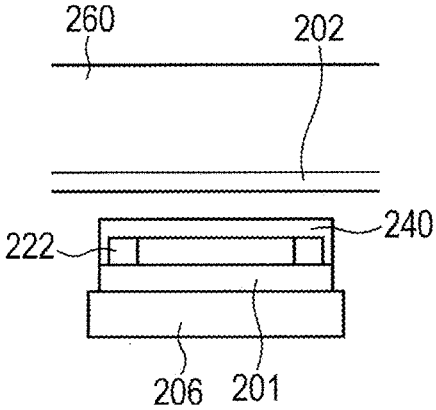
Figure 14C:
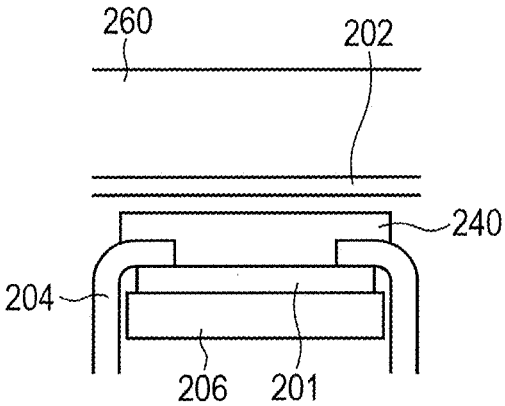
Figure 14F:
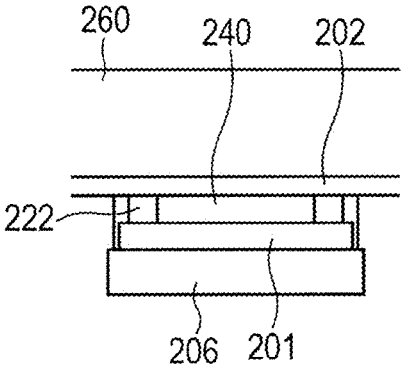
Figure 14G:
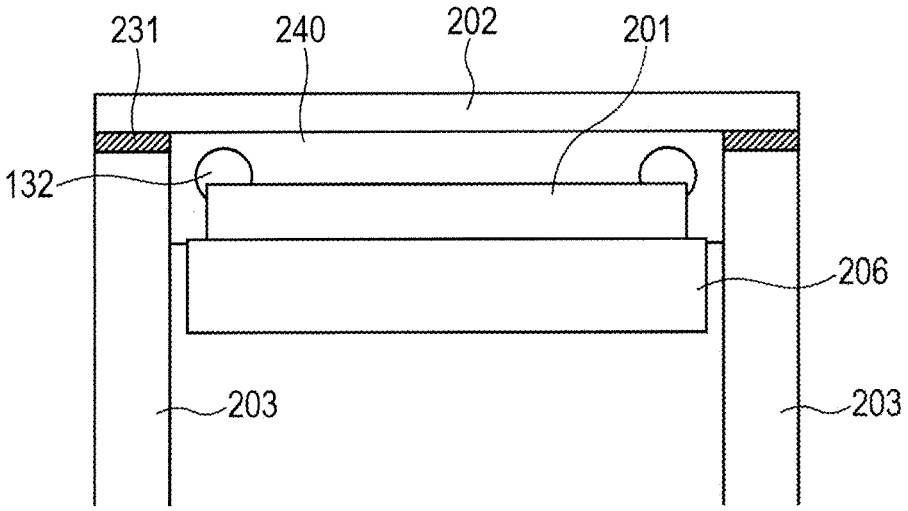
Figure 14H:
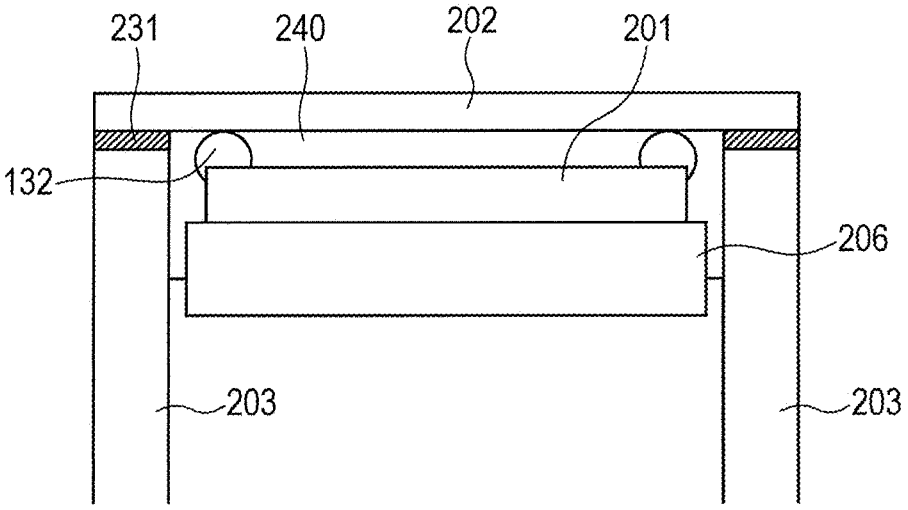
Figure 15A:
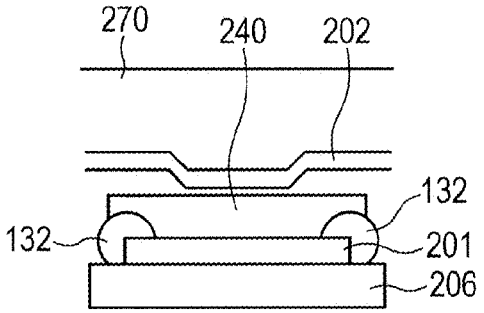
FIGS. 15A, 15B, 15C, 15D, 15E, and 15F are diagrams of a manufacturing method for a capacitance type transducer according to a fifteenth embodiment.
Figure 15D:
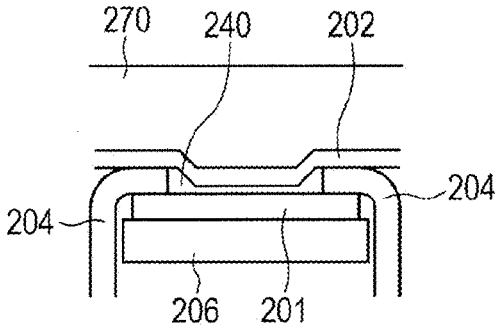
Figure 15B:
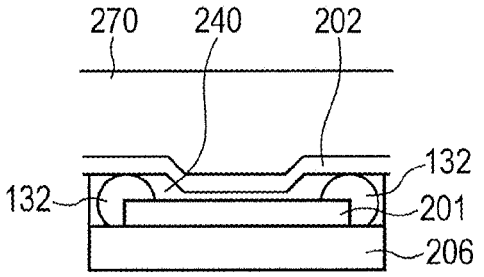
Figure 15E:
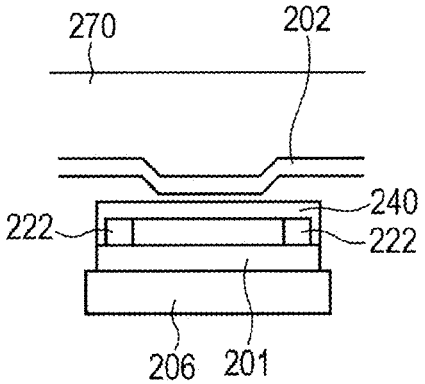
Figure 15C:
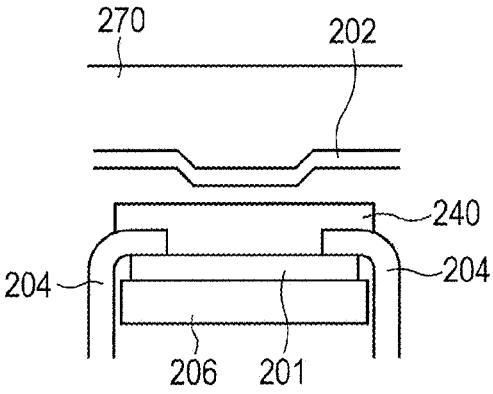
Figure 15F:
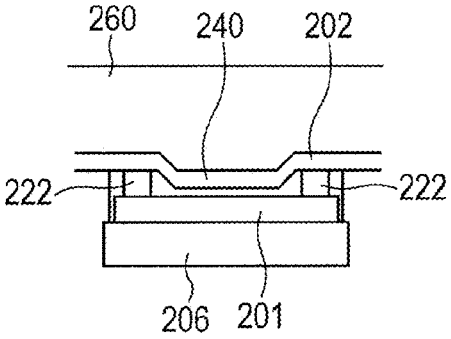

The thickness setting section is not limited to the sealing material 132 that seals the wire 131. Any member can be used as long as the member is determined at the predetermined height. As illustrated in FIGS. 14C and 14D, the flexible wiring board 204 can also be used. In this case, the flexible wiring board 204 can be set to low uniform height compared with the sealing material 132 that seals the wire 131. Therefore, it is possible to obtain smaller uniform thickness of the silicone layer 205. As illustrated in FIGS. 14E and 14F, by using the spacers 222, it is possible to dispose the thickness setting section in any optimum position without being limited by the disposed position of the electrodes 109 and 110 on the substrate 201. The thickness of the spacers 222 is not limited by a draw-out wire. Therefore, it is possible to use the spacers 222 having optimum thickness and obtain more suitable thickness. FIGS. 14G and 14H are diagrams illustrating the overall processes illustrated in FIGS. 14A and 14B.

Note that, in this embodiment, the process performed using the configuration in which the unhardened silicone resin 240 is applied on the substrate 201 described in the eleventh embodiment and the twelfth embodiment is described. However, this embodiment is not limited to this process. This embodiment can also be the process performed using the configuration in which the silicone resin 240 is applied on the sheet 202 side described in the thirteenth embodiment. According to this embodiment, it is possible to more accurately define the distance between the sheet 202 and the substrate 201. Therefore, it is possible to more accurately set the thickness of the silicone layer 205 between the sheet 202 and the substrate 201.

Fifteenth Embodiment

This embodiment is different from the fourteenth embodiment in the surface shape of a holding member. FIGS. 15A to 15F are schematic diagrams for describing this embodiment. In this embodiment, the surface shape of a holding jig 270 has a convex shape. A convex portion plane of the convex shape of the holding jig 270 covers a region where the CMUT 100 is formed on the substrate 201. A manufacturing process itself is the same as the manufacturing process in the fourteenth embodiment except that the shape of the holding jig 270 is different. However, it is necessary to add a jig for determining a positional relation between the holding jig 270 and the substrate 201, on which the CMUT 100 is formed, before the substrate 201 is brought close to the sheet 202 side or a process for adjusting the positional relation before the substrate 201 is brought close to the sheet 202 side. The jig and the process can be easily realized by, using a general-purpose packaging technique, a jig with a highly accurate positioning function and a stage having a fine adjustment function. When the holding jig 270 in this embodiment is used, the thickness of the silicone layer 205 present between a plane on which the CMUT 100 is formed and a sheet on the CMUT 100 can be set smaller than the height of the sealing material 132 (the thickness setting section).

The thickness setting section is not limited to the sealing material 132, which seals the wire 131, and only has to be a member determined at predetermined height. As in the fourteenth embodiment, the flexible wiring board 204 (FIGS. 15C and 15D) and the spacers 222 (FIGS. 15E and 15F) can be used.

According to this embodiment, it is possible to further reduce the distance to the sheet on the CMUT. Therefore, it is possible to provide a manufacturing method for a capacitance type transducer with less deterioration in an ultrasonic wave characteristic and excellent in a transmission and reception characteristic.

Sixteenth Embodiment

This embodiment relates to a manufacturing method including the process for fixing the substrate 201, on which the CMUT 100 is formed, and the sheet 202 using the silicone layer 205 in the manufacturing method described in the thirteenth embodiment. In this embodiment, the thickness of the silicone layer 205 is defined by thickness setting section disposed on the substrate 201. External force is applied to the substrate 201 such that the surface of the sheet 202 on the substrate 201 is further on the outer side than the sheet surface on the frame 203. Processes are specifically described with reference to FIGS. 16A to 16C.

Figure 16A:
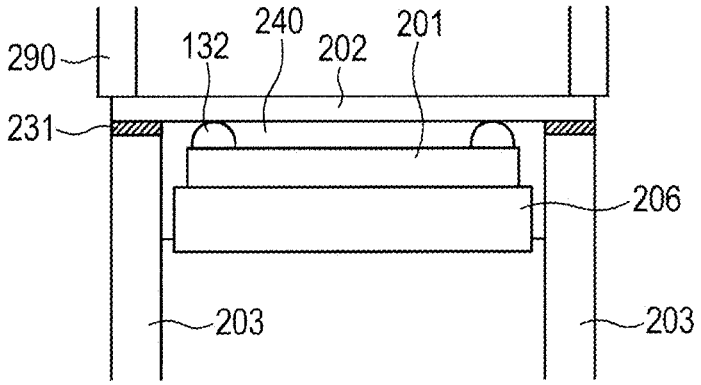
FIGS. 16A, 16B, and 16C are diagrams of a manufacturing method for a capacitance type transducer according to a sixteenth embodiment.
Figure 16B:
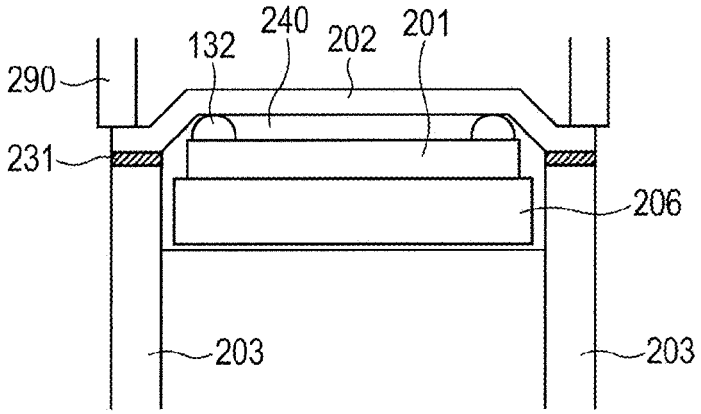
Figure 16C:
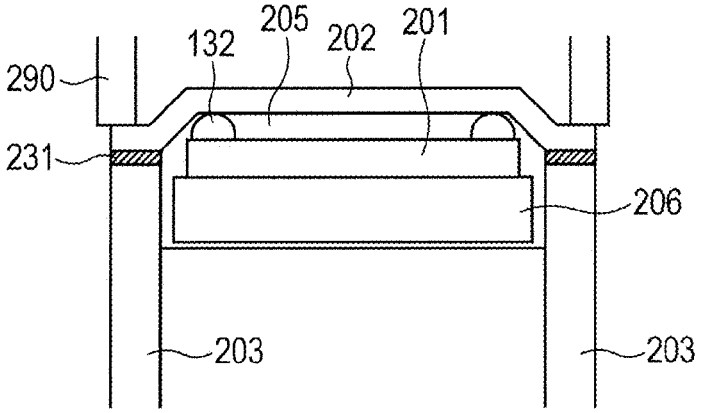

On the substrate 201 in this embodiment, a member (thickness setting section) determined at predetermined height is disposed in order to define the height between the sheet 202 and the substrate 201. In FIGS. 16A to 16C, the sealing material 132, which seals the wire 131, is used. Processes after the process in FIG. 13F in the thirteenth embodiment are described. This embodiment is different from the thirteenth embodiment in that the frame 203 is held by a holding jig 290 and, even if external force is applied to the upper side (on the figure) of the frame 203, the frame 203 does not move. Further, this embodiment is different from the thirteenth embodiment in that, even after coming into contact with the surface of the sheet 202, the sealing material 132 on the substrate 201 does not stop and the substrate 201 moves to the upper side. Therefore, when external force applied to the upper side of the substrate 201 is transmitted to the sheet 202, since the frame portion is held by the holding jig 290, the external force is transmitted to the sheet 202 via the sealing material 132 on the substrate 201. Since the sheet 202 is extremely thin and high in stretchability, the sheet 202 is slightly deformed to have a convex shape on the upper side on the substrate 201 without being fractured (FIG. 16B). The height of a convex section can be set to approximately several micrometers to several hundred micrometers.

When the substrate 201 comes to a desired position with respect to the frame 203, the movement of the substrate 201 is stopped. While this state is maintained, by hardening the silicone layer 205, the sheet 202 is fixed while keeping the convex shape (FIG. 16C). At this point, the interval between the plane, on which the CMUT 100 is formed on the substrate 201, and the sheet 202 on the plane has a value same as the height of the sealing material 132 (the thickness setting section). Therefore, the thickness of the silicone layer 205 present between the plane, on which the CMUT 100 is formed, and the sheet 202 on the CMUT 100 also has a value same as the height of the sealing material 132 (the thickness setting section). The sheet 202 is pushed to the upper side and fixed by the substrate 201 with the ends thereof kept fixed to the frame 203. Compared with when the sheet 202 is not pushed, tension is applied to the sheet 202. Therefore, the sheet 202 is stretched out and tensed. As described in the fourteenth and fifteenth embodiments, even if a holding jig having a flat shape on the sheet upper side is not used, the thickness of the silicone layer 205 can be set to a fixed value. Therefore, since it is unnecessary to bring the silicone layer 205 into contact with the surface of the sheet 202 on the CMUT 100, the sheet 202 is not scratched by dust adhering to the surface of the holding jig. The water vapor permeability of the sheet 202 is not deteriorated. That is, water resistance of the sheet 202 is kept.

The thickness setting section is not limited to the sealing material 132 that seals the wire 131. Any member can be used as long as the member is a member determined at predetermined height. As in the fourteenth embodiment, the flexible wiring board 204 can also be used. In this case, the flexible wiring board 204 can be set to low uniform height compared with the sealing material 132 that seals the wire 131. Therefore, it is possible to obtain smaller uniform thickness of the silicone layer 205. By using the spacers 222, it is possible to dispose the thickness setting section in any optimum position without being limited by the disposed position of the electrodes 109 and 110 on the substrate 201. The thickness of the spacers 222 is not limited by a draw-out wire. Therefore, it is possible to use the spacers 222 having optimum thickness and obtain more suitable thickness.

Note that, in this embodiment, the holding jig 290, which holds the frame 203, is pressed from the upper side of the frame 203. However, this embodiment is not limited to this. Any holding jig such as a holding jig that clamps and holds the frame 203 from the sides can be used as long as the frame 203 is not moved by external force applied to the substrate 201 in the process.

According to this embodiment, it is possible to provide a manufacturing method for a capacitance type transducer not damaging the surface of the sheet 202, having high reliability, small in size, and excellent in a transmission and reception characteristic. In the above description of the manufacturing processes, the sheet 202 is disposed on the upper side on the figure with respect to the frame 203. However, this embodiment is not limited to this. The capacitance type transducer can be manufactured by directing the sheet 202 downward or sideways with respect to the frame 203. In that case, the sheet 202 can be used in any direction as long as a problem of liquid drip does not occur when an unhardened adhesive or unhardened silicone resin is applied.

Seventeenth Embodiment

A seventeenth embodiment relates to an ultrasonic probe including the capacitance type transducer according to any one of the first to tenth embodiments or the capacitance type transducer manufactured by the manufacturing method according to any one of the eleventh to sixteenth embodiments.

Figure 17A:
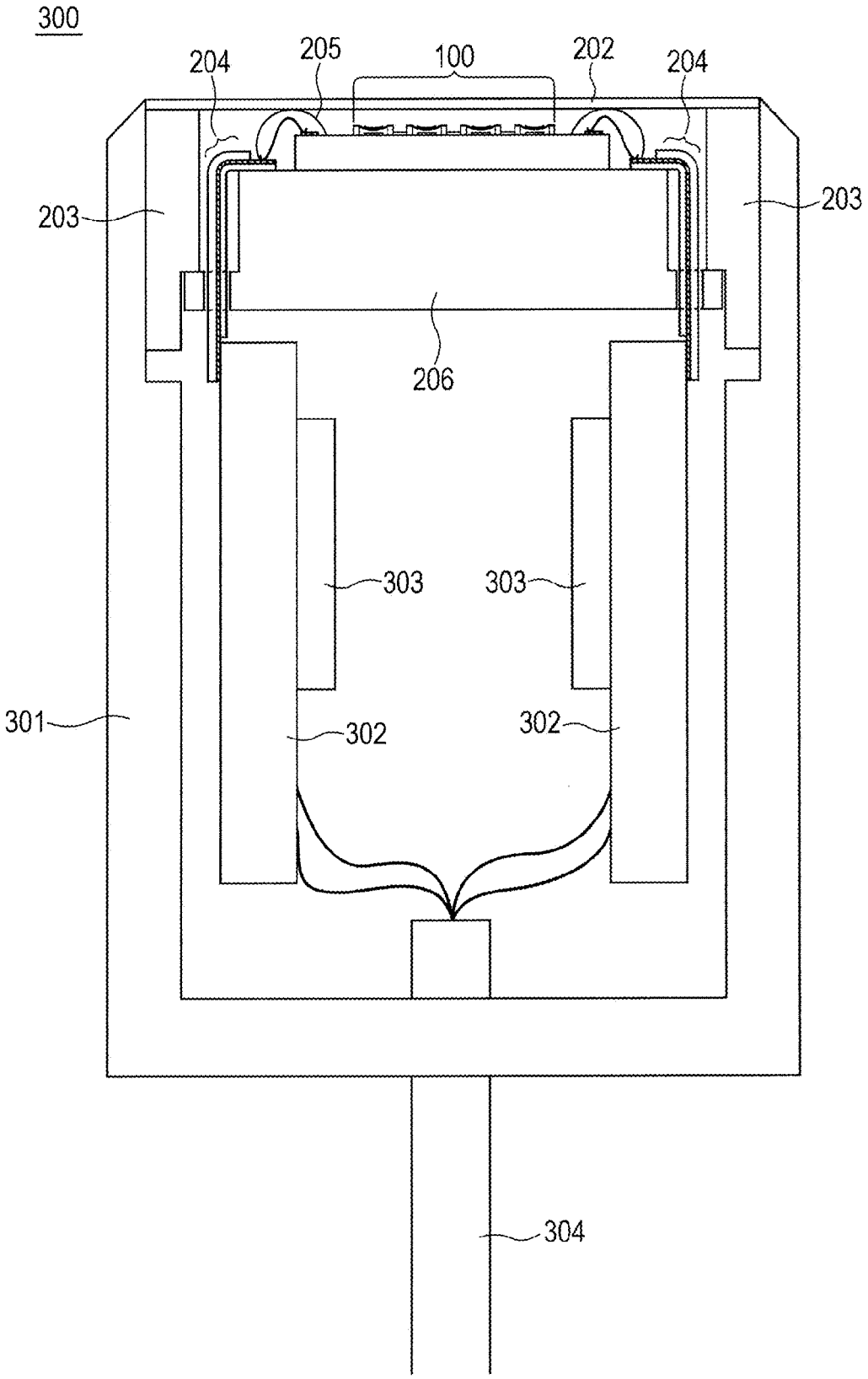
FIG. 17A is a diagram for describing an ultrasonic probe according to a seventeenth embodiment.

The configuration of the ultrasonic probe including the capacitance type transducer of the present invention is described with reference to FIGS. 17A and 17B. FIG. 17A is a schematic diagram of the ultrasonic probe including the capacitance type transducer in this embodiment. In FIG. 17A, an ultrasonic probe 300 includes a housing 301, a circuit board 302, a transmission and reception circuit 303, and a cable 304. The frame 203 including the CMUT 100 and the circuit board 302 are surrounded by the housing 301 and bonded and held. The flexible wiring board 204 connected to the electrodes in the CMUT 100 is connected to the circuit board 302. The electrodes in the CMUT 100 are electrically connected to the transmission and reception circuit 303 on the circuit board 302. The transmission and reception circuit 303 connected to the electrodes is drawn out to the outer side of the housing 301 via the cable 304 connected to the circuit board 302 and connected to a subject information acquiring apparatus such as an ultrasonic image forming apparatus (not illustrated in the figure). The transmission and reception circuit 303 can perform exchange of transmission and reception signals.

The housing 301 can be easily formed using general resin. By using a material having low water vapor permeability as the housing 301, it is possible to prevent deterioration in electric characteristics of wires included in the circuit board 302, the flexible wiring board 204, and the cable 304. By using the capacitance type transducer of the present invention, it is possible to reduce intrusion of water vapor from the outside with a small configuration. Therefore, it is possible to reduce the probe itself in size and prevent intrusion of water vapor. Therefore, by using the capacitance type transducer of the present invention in an ultrasonic probe, it is possible to provide a probe having high reliability and small in size.

Figure 17B:
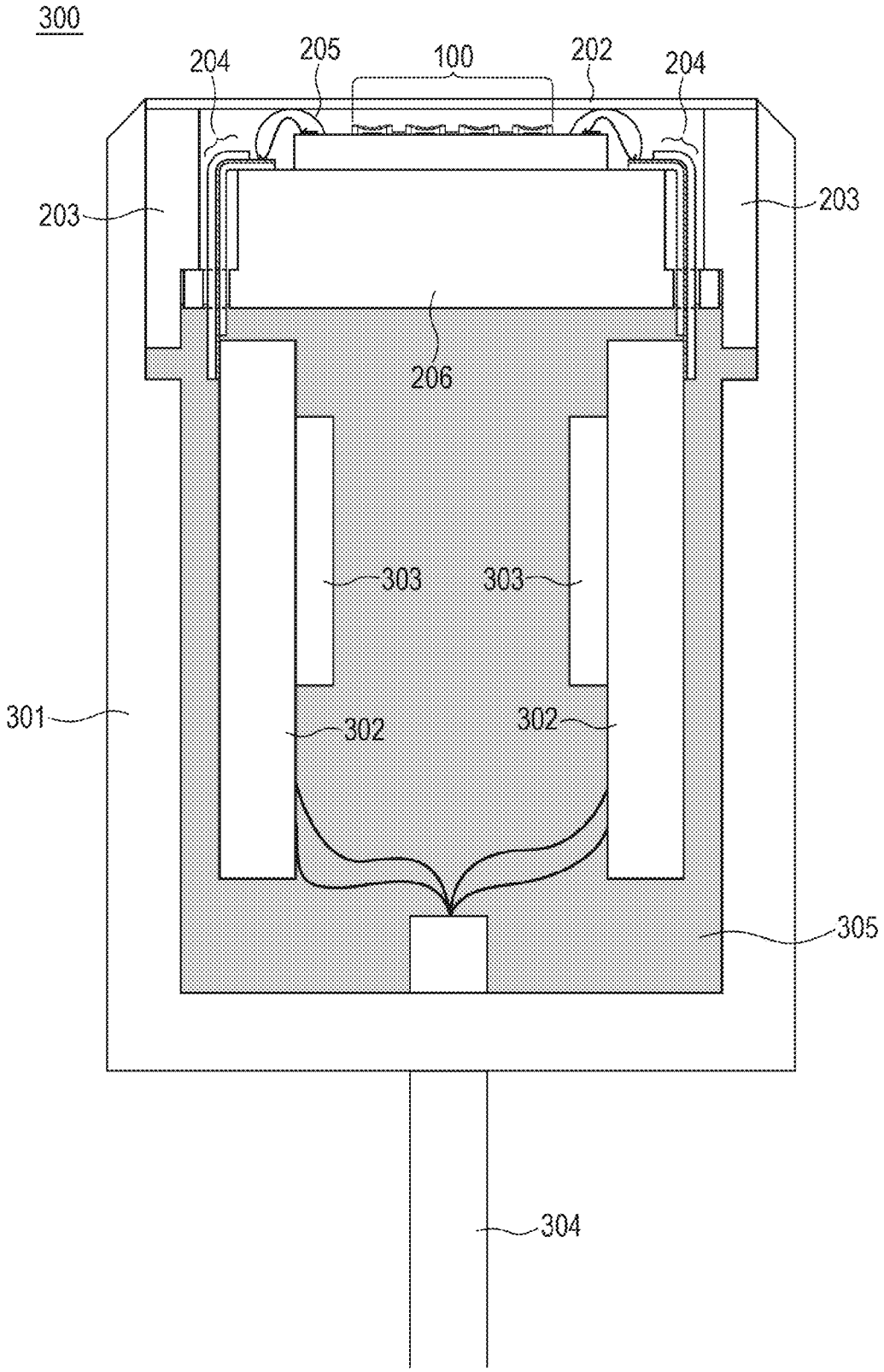
FIG. 17B is a diagram for describing another example of the ultrasonic probe according to the seventeenth embodiment.

Note that, in this embodiment, as illustrated in FIG. 17B, the inside of the ultrasonic probe 300 can be completely filled by the sealing material 304. Consequently, even if moisture intrudes from a joint of the housing 301, it is possible to prevent further intrusion of moisture with the sealing material 305. Therefore, even when the ultrasonic probe 300 is used in water, it is possible to provide the ultrasonic probe 300 having high reliability.

Eighteenth Embodiment

An eighteenth embodiment relates to a subject information acquiring apparatus such as an ultrasonic image forming apparatus including the capacitance type transducer described in any one of the first to sixteenth embodiments or the ultrasonic probe described in the seventeenth embodiment. The subject information acquiring apparatus is described as the ultrasonic image forming apparatus below.

Figure 18:
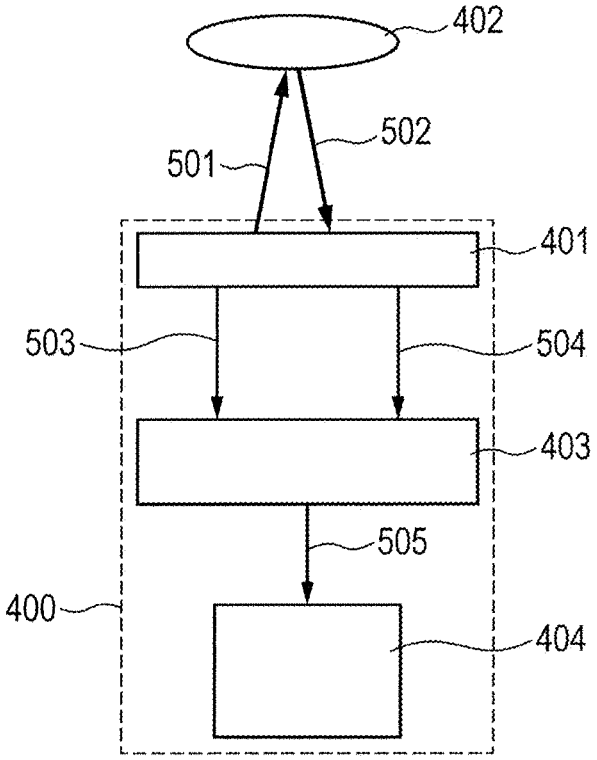
FIG. 18 is a diagram for describing a subject information acquiring apparatus according to an eighteenth embodiment.
Figure 19:
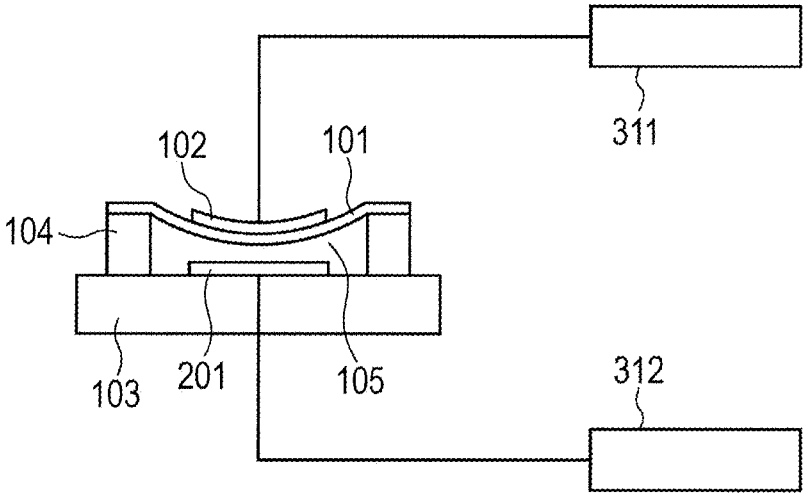
FIG. 19 is a diagram for describing a conventional capacitance type transducer.

The ultrasonic image forming apparatus in this embodiment is described with reference to FIG. 18. An ultrasonic image forming apparatus 400 includes a capacitance type transducer (an ultrasonic probe) 401 that receives an acoustic wave from a subject and converts the acoustic wave into an electric signal, a subject or a measurement target 402, an image-information generating unit 403, which is a processing unit that acquires information concerning the subject using the electric signal, and an image display unit 404. The capacitance type transducer 401 transmits an ultrasonic wave 501 and receives a reflected ultrasonic wave 502. The capacitance type transducer 401 sends ultrasonic wave transmission information 503 and an ultrasonic wave reception signal 504 to the image-information generating unit 403. The image-information generating unit 403 sends reproduced image information 505 to the image display unit 404.

The operation of the ultrasonic image forming apparatus 400 that measures a transmitted ultrasonic wave is described below. The capacitance type transducer (the ultrasonic probe) 401 outputs (transmits) the ultrasonic wave 501 to the measurement target 402. The ultrasonic wave 501 is reflected on the surface of the measurement target 402 according to a difference in intrinsic acoustic impedance on the interface of the surface. The capacitance type transducer (the ultrasonic probe) 401 receives the reflected ultrasonic wave 502 and sends information concerning the magnitude, the shape, and the time of a received signal to the image-information generating unit 403 as the ultrasonic wave reception signal 504. On the other hand, the image-information generating unit 403 stores the information concerning the magnitude, the shape, and the time of a transmitted ultrasonic wave. The image-information generating unit 403 generates an image signal of the measurement target 402 on the basis of the ultrasonic wave reception signal 504 and the ultrasonic wave transmission information 503 and outputs the image signal as the reproduced image information 505. The image display unit 404 displays the measurement target 402 as an image on the basis of the reproduced image information 505 obtained by the ultrasonic wave transmission and reception.

The ultrasonic image forming apparatus 400 can further include a light source. The capacitance type transducer 401 can receive a photoacoustic wave generated by irradiation of light from the light source on the subject and convert the photoacoustic wave into an electric signal. In such a configuration, the image display unit 404 displays the measurement target 402 as an image on the basis of reproduced image information obtained by the reception of the photoacoustic wave. Alternatively, the image display unit 404 can display the measurement target 402 as an image on the basis of two kinds of information, i.e., the reproduced image information obtained by the ultrasonic wave transmission and reception and the reproduced image information obtained by the reception of the photoacoustic wave.

The ultrasonic image forming apparatus 400 in this embodiment uses the capacitance type transducer 401 of the present invention. The capacitance type transducer 401 has high reliability and is small in size and excellent in a transmission and reception characteristic. Therefore, it is possible to provide a subject information acquiring apparatus such as an ultrasonic image forming apparatus that has high reliability, includes a small ultrasonic-wave measuring unit, and can perform high-quality image formation through a satisfactory transmission and reception characteristic of an ultrasonic wave.

According to the present invention, it is possible to realize a capacitance type transducer that can reduce, with the water-resistant sheet and the water-resistant frame, corrosion of a wire due to intrusion of substances from the outside and has a reduced influence on a transmission and reception characteristic.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-082382, filed Apr. 12, 2014, which is hereby incorporated by reference herein in its entirety.

What is claimed is:

1. A capacitance type transducer comprising:

one or more cells having a structure in which a vibrating film including one electrode of a pair of electrodes formed spaced apart from each other is supported to be capable of vibrating;

a substrate, on one surface of which the one or more cells are disposed;

a sheet having water resistance;

an acoustic matching layer provided between the sheet and the one or more cells; and a frame having water resistance and disposed to surround a side surface of the substrate, wherein the sheet is bonded to an end face of the frame to cover an opening of the frame, wherein, on the substrate, there are a cell region where the one or more cells are located and an electric connection region to connect the electrode of the one or more cells with an electrical circuit, and wherein a distance between the substrate and the sheet in the cell region is smaller than the distance between the substrate and the sheet in the electric connection region.

2. The capacitance type transducer according to claim 1, wherein the sheet has a thickness of 30 μm or less.

3. The capacitance type transducer according to claim 1, wherein moisture permeability of the sheet is 100 $g/m^2$ per day or less.

4. The capacitance type transducer according to claim 1, wherein, on a surface of the sheet, a recess is formed in the cell region rather than in a vicinity of the frame.

5. The capacitance type transducer according to claim 4, wherein, compared with the cell region, the acoustic matching layer is formed thicker in a region on an outer side of the cell region.

6. The capacitance type transducer according to claim 5, wherein a thickness of the matching layer in the cell region is 20 micrometers to 40 micrometers.

7. The capacitance type transducer according to claim 6, wherein the capacitance type transducer is configured to be suitable for ultrasonic wave transmission and reception centering on a frequency of 4 megahertz.

8. The capacitance type transducer according to claim 5, wherein a thickness of the matching layer in the cell region is 20 micrometers to 24 micrometers.

9. The capacitance type transducer according to claim 8, wherein the capacitance type transducer is configured to be suitable for ultrasonic wave transmission and reception centering on a frequency of 8 megahertz.

10. The capacitance type transducer according to claim 5, wherein a thickness of the matching layer outside the cell region is 40 micrometers to 100 micrometers.

11. The capacitance type transducer according to claim 1, wherein a reflecting film that reflects light having a predetermined wavelength is formed on a surface of the sheet.

12. The capacitance type transducer according to claim 1, wherein the sheet includes a layer formed of an inorganic material.

13. The capacitance type transducer according to claim 1, wherein the sheet is a sheet of any one of polyethylene terephthalate, polyethylene naphthalate, and polypropylene.

14. The capacitance type transducer according to claim 1, wherein the capacitance type transducer includes, on a surface side of the sheet, an acoustic lens formed of silicone.

15. The capacitance type transducer according to claim 1, wherein a material of the frame is metal.

16. The capacitance type transducer according to claim 1, wherein, on a surface side opposite to the one surface of the substrate, a gap between the frame and the substrate or a gap between the frame and a supporting member that supports the substrate is filled with epoxy resin.

17. The capacitance type transducer according to claim 1, wherein:

a supporting member that supports the substrate is disposed on a surface side opposite to the one surface of the substrate, and an abutting structure that defines positions of the one surface of the substrate and the end face of the frame is provided in the supporting member and the frame.

18. The capacitance type transducer according to claim 1, further comprising a flexible wiring board including a wire connected to electrodes of the one or more cells, wherein:

a part of the flexible wiring board is disposed on the one surface of the substrate, and a part of the flexible wiring board is disposed in contact with a surface of the sheet on a substrate side.

19. The capacitance type transducer according to claim 1, wherein:

the substrate includes a through-wire, and an electrode electrically connected to the through-wire to draw out the wire to an outside of the substrate is provided on a substrate surface on an opposite side of the one surface of the substrate.

20. The capacitance type transducer according to claim 1, wherein the one surface of the substrate is disposed further on an outer side than the end face of the frame on the one surface side.

21. The capacitance type transducer according to claim 1, wherein the acoustic matching layer is a silicone layer.

22. A subject information acquiring apparatus comprising:

the capacitance type transducer according to claim 1; and a processing unit, wherein:

the capacitance type transducer receives an acoustic wave from a subject and converts the acoustic wave into an electric signal, and the processing unit acquires information concerning the subject using the electric signal.

23. The subject information acquiring apparatus according to claim 22, further comprising a light source, wherein the capacitance type transducer receives a photoacoustic wave generated by irradiation of light from the light source on the subject and converts the photoacoustic wave into an electric signal.

24. The subject information acquiring apparatus according to claim 22, wherein:

the processing unit is an image-information generating unit that generates a signal of image information, and the subject information acquiring apparatus is configured as an ultrasonic image forming apparatus including an image display unit that displays an image based on the signal of the image information.

25. A capacitance type transducer comprising:

one or more cells having a structure in which a vibrating film including one electrode of a pair of electrodes formed spaced apart from each other is supported to be capable of vibrating;

a substrate, on one surface of which the one or more cells are disposed;

a sheet having water resistance;

an acoustic matching layer provided between the sheet and the one or more cells; and a frame having water resistance and disposed to surround a side surface of the substrate, wherein the sheet is bonded to an end face of the frame to cover an opening of the frame, wherein, on the substrate, there are a cell region where the one or more cells are located and an electric connection region to connect the electrode of the one or more cells with an electrical circuit, and wherein a distance between the substrate and the sheet in the cell region is substantially equal to the distance between the substrate and the sheet in the electric connection region.

26. The capacitance type transducer according to claim 25, wherein in the electric connection region, the electrode of the one or more cells is connected with the electrical circuit via an electric wire and an electrode provided on the substrate.

27. The capacitance type transducer according to claim 25, wherein the electrical circuit contains a flexible wiring board.

28. The capacitance type transducer according to claim 27, wherein a conductive layer of the flexible wiring board and an electrode on the substrate are connected.

29. The capacitance type transducer according to claim 27, wherein the flexible wiring board and an electrode on the substrate are connected using an anisotropically conductive resin.

30. The capacitance type transducer according to claim 25, wherein in the electric connection region, a through-wire that electrically connects the one surface of the substrate and its opposite surface is provided in the substrate.

31. The capacitance type transducer according to claim 30, wherein the electrical circuit contains a flexible wiring board.

32. The capacitance type transducer according to claim 31, wherein the flexible wiring board and the electrode of the one or more cells are connected via the through-wire.

33. A subject information acquiring apparatus comprising:

the capacitance type transducer according to claim 25; and a processing unit, wherein:

the capacitance type transducer receives an acoustic wave from a subject and converts the acoustic wave into an electric signal, and the processing unit acquires information concerning the subject using the electric signal.

34. A capacitance type transducer comprising:

one or more cells having a structure in which a vibrating film including one electrode of a pair of electrodes formed spaced apart from each other is supported to be capable of vibrating;

a substrate, on one surface of which the one or more cells are disposed;

a sheet having water resistance;

an acoustic matching layer provided between the sheet and the one or more cells; and a frame having water resistance and disposed to surround a side surface of the substrate, wherein the sheet is bonded to an end face of the frame to cover an opening of the frame, and wherein a part of the sheet forms a projection portion projecting to an outer side other than to the end face of the frame.

35. The capacitance type transducer according to claim 34, wherein, on the substrate, there are a cell region where the one or more cells are located and an electric connection region to connect the electrode of the one or more cells with an electrical circuit, and wherein the cell region and the electric connection region are included in the projection portion.

36. A subject information acquiring apparatus comprising:

the capacitance type transducer according to claim 34; and a processing unit, wherein:

the capacitance type transducer receives an acoustic wave from a subject and converts the acoustic wave into an electric signal, and the processing unit acquires information concerning the subject using the electric signal.

* * * * *